US007872377B2

(12) United States Patent
Wilson

(10) Patent No.: US 7,872,377 B2
(45) Date of Patent: Jan. 18, 2011

(54) COMMUNICATIONS IN MULTIPLE-SWITCH ELECTRICAL CIRCUITS

(76) Inventor: Phillip C. Wilson, P.O. Box 607, Villanova, PA (US) 19085

( * ) Notice: Subject to any disclaimer, the term of this patent is extended or adjusted under 35 U.S.C. 154(b) by 42 days.

(21) Appl. No.: 12/353,991

(22) Filed: Jan. 15, 2009

(65) Prior Publication Data

US 2010/0176661 A1 Jul. 15, 2010

(51) Int. Cl.
*H01H 9/16* (2006.01)

(52) U.S. Cl. ..... 307/114

(58) Field of Classification Search ..... 307/114
See application file for complete search history.

(56) References Cited

U.S. PATENT DOCUMENTS

| | | | | |
|---|---|---|---|---|
| 3,119,046 | A | 1/1964 | Usher | |
| 4,255,780 | A | 3/1981 | Sakellaris | |
| 4,514,789 | A | 4/1985 | Jester | |
| 4,755,913 | A | 7/1988 | Sleveland | |
| 5,519,263 | A | 5/1996 | Santana | |
| 5,748,094 | A | 5/1998 | Neathway | |
| 5,798,581 | A | 8/1998 | Keagy | |
| 5,920,156 | A | 7/1999 | Carson | |
| 6,570,493 | B1 * | 5/2003 | Rotem | 340/310.11 |
| 6,845,274 | B2 | 1/2005 | Wang | |
| 7,247,999 | B2 | 7/2007 | Kumar | |
| 7,416,310 | B1 * | 8/2008 | Savicki, Jr. | 362/95 |
| 7,656,308 | B2 * | 2/2010 | Atkins | 340/825.72 |
| 7,723,925 | B2 * | 5/2010 | Mosebrook et al. | 315/246 |
| 2007/0007826 | A1 | 1/2007 | Mosebrook | |
| 2007/0188025 | A1 | 8/2007 | Keagy | |
| 2008/0218319 | A1 * | 9/2008 | Schoettle | 340/310.11 |

* cited by examiner

*Primary Examiner*—Jared Fureman
*Assistant Examiner*—Adi Amrany

(57) ABSTRACT

A system, device and method to allow communications between switches in an electrical circuit containing three-way and four-way switches. The system, device and method allow any switch in an electrical circuit using conventional wiring for three-way and four-way switches to indicate when voltage is being supplied to the electrical load device in the electrical circuit; if a dimmer is present in the electrical circuit, to indicate the dim level of the load device in the electrical circuit and to command to dim level from any switch; and if a timer is present, to allow any switch to provide a warning indication prior to the timer shutting off the load device, and to allow any switch to reset the timer, preventing the shutoff.

54 Claims, 11 Drawing Sheets

COMMUNICATIONS IN MULTIPLE-SWITCH ELECTRICAL CIRCUITS

FIELD OF THE INVENTION

The present invention relates to a system, device and method for communicating between switches in an electrical circuit containing three-way and four-way switches using conventional wiring for three-way and four-way switches.

BACKGROUND OF THE INVENTION

Three-way and four-way switches are used in electrical circuits to toggle voltage to an electrical device, most often a lighting fixture, from two or more locations. For example, two three-way switches can be used to control a light at the top of a stairway from both the top and bottom of the stairway. When more than two switch locations are required to control the electrical load, any number of four-way switches are used between the two three-way switches in the electrical circuit, e.g., an electrical circuit requiring five switches to control a single light fixture would contain two three-way switches and three four-way switches.

In a electrical circuit containing a single switch, the task of determining whether the circuit is supplying voltage to the electrical load device in the electrical circuit is a simple one. Typically if the switch is "up", it indicates that voltage is being supplied to the load—the switch is in the "on" position, and if the switch is "down", it indicates that voltage is not being supplied to the load—the switch is in the "off" position. Additionally the words "ON" and "OFF" are typically visible on the moveable portion of the standard wall switch. If an indicator light, designed to show when voltage is being supplied to the load, were present in a standard single-pole single throw (SPST) wall switch, a circuit within the switch could easily supply the appropriate voltage to the indicator light by tapping the terminal connected to the load-side "hot" wire, causing the indicator light to illuminate when the switch supplies AC mains voltage ("line voltage") to the load.

Three-way switches and four-way switches however do not contain the words "ON" or "OFF" because any switch in the electrical circuit could either be in the "up" or "down" position when voltage is being supplied to the load, depending on the position(s) of the other switch(es) in the electrical circuit. Sometimes one can simply observe the load device that the switch is controlling to determine whether voltage is being supplied i.e., look at the lighting fixture to visually determine whether the light bulb is illuminated. At other times, observation is not feasible, not practical, or not possible.

Providing an indicator at each switch in a electrical circuit containing three-way or three-way and four-way switches that shows when voltage is being supplied to the load is a challenge in that in the most used wiring configuration for three-way and four way switches, whether voltage is being supplied to the load device in the electrical circuit is only "known" to one switch, the switch adjacent to the load—if the "common" terminal on the load-side three-way switch has voltage, then voltage is being supplied to the load. All other switches in the electrical circuit would have to be "told" whether voltage is being supplied to the load.

When using "conventional wiring" for circuits containing three-way and four-way switches, each three-way and four-way switch in the electrical circuit is connected to the next switch in the electrical circuit by two "traveler wires" or "travelers". One of the two traveler wires between any two switches will carry line voltage and the other traveler of the pair will not carry line voltage. After a toggle of any switch in the electrical circuit, in one or more of the pair of traveler wires between the switches, the traveler carrying line voltage will shift to the other wire of the pair.

Dimmer switches can be used in electrical circuits wired for three-way switches and four-way switches. These switches are typically called "3-way dimmer" switches. In any given electrical circuit, typically there is only one switch containing dimming circuitry, performing the dimming or "load limiting" function. This switch is referred to as the "master dimmer" switch or simply as the "dimmer switch" or the "dimmer". Additional switches called "accessory dimmers", "auxiliary dimmers" or "remote dimmers" can be included in the electrical circuit to allow multiple switch locations to control the dim level of the load, but these additional switches are not dimmer switches but switches that communicate with the dimmer switch, able to command the dimmer switch to set the load to a particular dim level.

In an electrical circuit containing only two three-way switches, either of the two three-way switches can be replaced with a dimmer switch to control the dim level of the load. The dim level however can only then be controlled from the dimmer switch; the remaining three-way switch can only turn the load "on" or "off". If the second three-way switch in that electrical circuit were replaced with a remote dimmer, one of the traveler wires would have to be used to communicate from the remote switch to the dimmer switch so that both switches could control the dim level of the load. The electrical circuit would then no longer be using conventional wiring for three-way switches. Similarly, in a circuit with two-three way switches and one or more four-way switches, if one switch is replaced with a dimmer switch, the wiring remains "conventional" and the remaining standard three-way and four-way switches will function in the electrical circuit albeit only to turn the load "on" or "off". To allow more than one switch location to control the dim level of the load requires the use of remote dimmers. Since one of the travelers must then be used for the remote dimmers to communicate to the master dimmer, the wiring is no longer conventional and the other standard three-way and four way switches in the electrical circuit will no longer function. Consequently all of the remaining standard three-way and four-way switches must be replaced with remote dimmer switches.

Timer switches can be used in electrical circuits wired for three-way switches and four-way switches. These switches are typically used to save energy in office buildings, turning off lights at a preset time when the office is likely empty or used to turn lights "on" and "off" to give a "lived in" appearance to a home from the outside when homeowners are away.

SUMMARY OF THE INVENTION

In circuits containing three-way and four-way switches using conventional wiring, each three-way switch and four-way switch is connected to the next switch by two traveler wires. One wire of the two traveler wires between each switch carries line voltage and the other wire of the two does not carry line voltage. When line voltage is being supplied to the load, the series of travelers from switch to switch that are not carrying line voltage are connected to each other and are isolated from every other aspect of this and any other electrical circuit. In the present invention, this channel of unused travelers is used to communicate from one switch to another switch or from one switch to multiple switches. The present invention uses a "channel selector" to isolate the unused series of traveler wires after each toggle of any switch in the electrical circuit, and a "signal generator" and a "signal detector" to send and receive communications.

Although the channel selector can isolate the travelers for any type of communication between the switches, there are five specific communications that are the primary subject of the present invention, all communications occurring in electrical circuits that use conventional wiring for three-way and four-way switches.

The first communication is generated from the load-side three-way switch to all other switches in the electrical circuit when line voltage is being supplied to the load. This allows any switch in the electrical circuit to indicate when voltage is being supplied to the load, i.e. each switch is able to indicate the on/off status of the load, referred to as the "load status". In the prior art, a "load status" communication either requires additional wiring between switches; does not use conventional wiring for three-way and four-way switches—meaning that standard three-way and four-way switches cannot be used in the same circuit; or the communication takes place a conductor containing line voltage, making the communication more complex and requiring the setting of unique house and unit codes in each switch, different codes for each electrical circuit, to prevent a switch in one circuit responding to a signal meant for another electrical circuit. The system, device and method of the present invention function in electrical circuits wired using conventional wiring for three-way and four-way switches, no additional wiring is required, and standard three-way and four-way switches can coexist in the electrical circuit. Furthermore, since the channel is isolated, a switch in one circuit will not mistakenly respond to a signal sent in another circuit.

The second and third communications take place in electrical circuits in which one of the switches is a dimmer switch—a communication from the dimmer switch reporting the dim level of the load, such that all switches can indicate the dim level of the load, and a communication from any switch in the electrical circuit to the dimmer to command the dim level of the load. The system, device and method of the present invention work in electrical circuits wired using conventional wiring for three-way and four-way switches, therefore standard three-way and four-way switches can coexist in the electrical circuit with the device of the present invention. This is a significant advantage over the prior art in that for more than one switch location to control the dim level of the load, with the present invention, there is no need to install remote dimmers at every switch location, remote dimmers need only exist at the switch locations requiring dimming control of the load; the other three-way and four-way switch locations can contain standard three-way and four-way switches.

The fourth and fifth communications take place in electrical circuits in which one of the switches is a timer switch—a communication from the timer switch reporting that the load, typically a set of lights, will be shut off in a number of seconds, so that all switches can warn of the shutoff using an audible indicator or other means, and a communication from any switch in the electrical circuit to the timer switch to command a timer reset, such that the shutoff is cancelled or delayed. The system, device and method of the present invention work in electrical circuits wired using conventional wiring for three-way and four-way switches, therefore standard three-way and four-way switches can coexist in the electrical circuit with the device of the present invention.

DESCRIPTION OF THE RELATED ART

Illuminated light switches have long been used to locate light switches in the dark (U.S. Pat. No. 4,255,780 to Sakellaris and U.S. Pat. No. 4,514,789 to Jester). The primary purpose of the present invention is not to locate switches in the dark.

U.S. Pat. No. 4,755,913 to Sleveland teaches the use of a light emitting diode to indicate whether an electrical circuit using a standard SPST (ON/OFF) switch is supplying voltage to the load. However, the method of Sleveland will not work for three-way or four-way switches.

U.S. Pat. No. 3,119,046 to Usher teaches connecting an indicator at the junction of two impedances connected across the traveler wires in a circuit with three-way switches. With this arrangement, whether the indicator lamp illuminates depends on the voltage drop across the indicator lamp. As such, for example, if the load were a light bulb and the light bulb were burnt out, the indicator lamp would not illuminate, even if voltage were being provided to the fixture. And whereas this may be a useful for another purpose, the present invention is designed to indicate when voltage is being supplied to the load, independent of whether the bulb is working or burnt out. In addition, Usher teaches the use of only a single indicator for an entire circuit containing three-way or three-way and four-way switches. Since Usher relies on the voltage characteristics of the circuit to energize the indicator lamp, the impedance values across the traveler wires would be different for a two-indicator circuit, a three-indicator circuit, etc. Therefore, using the arrangement of Usher, if each switch were to have an indicator, each switch would have to be configured with impedance values based on the number of switches that were going to be used the circuit, making it impractical to offer a single device that works in different circuits with differing numbers of switches. The present invention teaches the use of a single indicator device that can be used in circuits with any number of switches, at any or all switch locations in the electrical circuit.

U.S. Pat. No. 5,748,094 to Neathway teaches the use of a transformer and a circuit that illuminates a light-emitting diode when current flow is detected in a circuit containing two three-way switches. The present invention works with any number of switches in a circuit containing three-way and four-way switches. In addition, similar to the arrangement in Usher discussed above, since Neathway relies on current passing through the circuit to illuminate the indicator, a circuit providing voltage to an empty electric socket or to a fixture with a burnt out or missing bulb would not illuminate the indicator. The indicators of the present invention show when voltage is being supplied to the load, whether a bulb is burnt out or not, or, if the circuit is designed to provide voltage to an electrical socket, whether an electrical device is plugged into the socket or not.

A "pilot light" switch uses electrical means to indicate when an electrical circuit is supplying voltage to the load. Two three-way "pilot light" switches in an electrical circuit however require an extra "switched-hot" and a neutral wire connected to the two switches in addition to the two standard "traveler" wires and the ground connection. A non-standard four wires plus a ground connection are required on each of the two three-way "pilot light" switches for the pilot light indicators on each switch to work properly. Four-way "pilot light" switches would theoretically require six wires plus a ground connection to each switch but are not currently being manufactured due the complex wiring that would be involved.

Unlike the "pilot light" switch, the present invention uses conventional wiring for three-way and four-way electrical circuits—two "traveler" wires connected between each switch and a ground connection—no extra wiring is required. In addition, the present invention works with four-way switches and can therefore easily be used in circuits requiring more that two switches with no additional wiring required.

U.S. Pat. No. 7,247,999 to Kumar teaches the use of a three-way dimmer switch without the need to replace the other three-way switch in the electrical circuit. The method of Kumar works in circuits containing only two switches. The present invention will work in electrical circuits with any number of three-way and four-way switches.

Both U.S. Pat. No. 5,798,581 to Keagy and U.S. Pat. Application No. 20070007826 by Mosebrook teach the use of a smart dimmer switch that can be used to replace the line-side three-way switch, the load-side three-way switch or any four-way switch in a multi-switch circuit, however the methods of Keagy and Mosebrook do not use conventional wiring and do not allow the use of standard three-way and four-way switches in the same circuit with the dimmer and the remote switches. The present invention allows the use of standard three-way and four-way switches in the same circuit with the dimmer and the remote dimmer switches.

BRIEF DESCRIPTION OF THE FIGURES

The accompanying drawings are for illustrative purposes only.

DESCRIPTION OF THE INVENTION

As used herein, the term "three-way switch" means a single-pole double-throw (SPDT) switch for use with AC mains voltage, switching an input terminal to one of two output terminals. Similarly, the term "four-way switch" means a double-pole double-throw (DPDT) switch for use with AC mains voltage, wired as an "intermediate switch" or "crossover switch"—that is, a switch in which a pair of input terminals A and B are connected to a pair of output terminals C and D, either A to C and B to D, or A to D and B to C.

In "conventional wiring" for electrical circuits containing multiple switches, each circuit has two three-way switches and any number of four-way switches connected between the two three-way switches. The first three-way switch has a common terminal connected to a hot conductor of the mains line and the other three-way switch has a common terminal connected to the load, and each switch in the electrical circuit is connected to a next switch in the electrical circuit by two traveler wires.

With each toggle of any switch in an electrical circuit containing three-way and four-way switches, the present invention isolates an unused series of traveler wires between the three-way and four-way switches for the purpose of sending and receiving communications from one switch to another switch or from one switch to multiple switches. There are five specific communications that are the primary subject of the present invention; a communication from the load-side three-way switch to all other switches in the electrical circuit, communicating that voltage is being provided to the load such that all switches activate a load status indicator; communications that take place when one of the switches is a dimmer switch—a communication from the dimmer switch reporting the dim level of the load such that all switches can indicate the dim level, and a communication from any switch in the electrical circuit to the dimmer switch to command the dim level of the load; and communications that take place when one of the switches is a timer switch—a communication from the timer switch reporting that the load will be shut off in a number of seconds such that all switches can sound a warning prior to the shutoff using e.g. an audible indicator, and a communication from any switch in the electrical circuit to the timer switch to command a timer reset, such that the shutoff is cancelled or delayed.

Other communications, not directly related to providing voltage to the load, could also occur on the isolated channel—detecting and reporting temperature or other environmental condition using a thermostat or an appropriate detector, sensing motion using a motion detector, or performing voice or other sound communications using a microphone and/or speaker.

Figure 1:
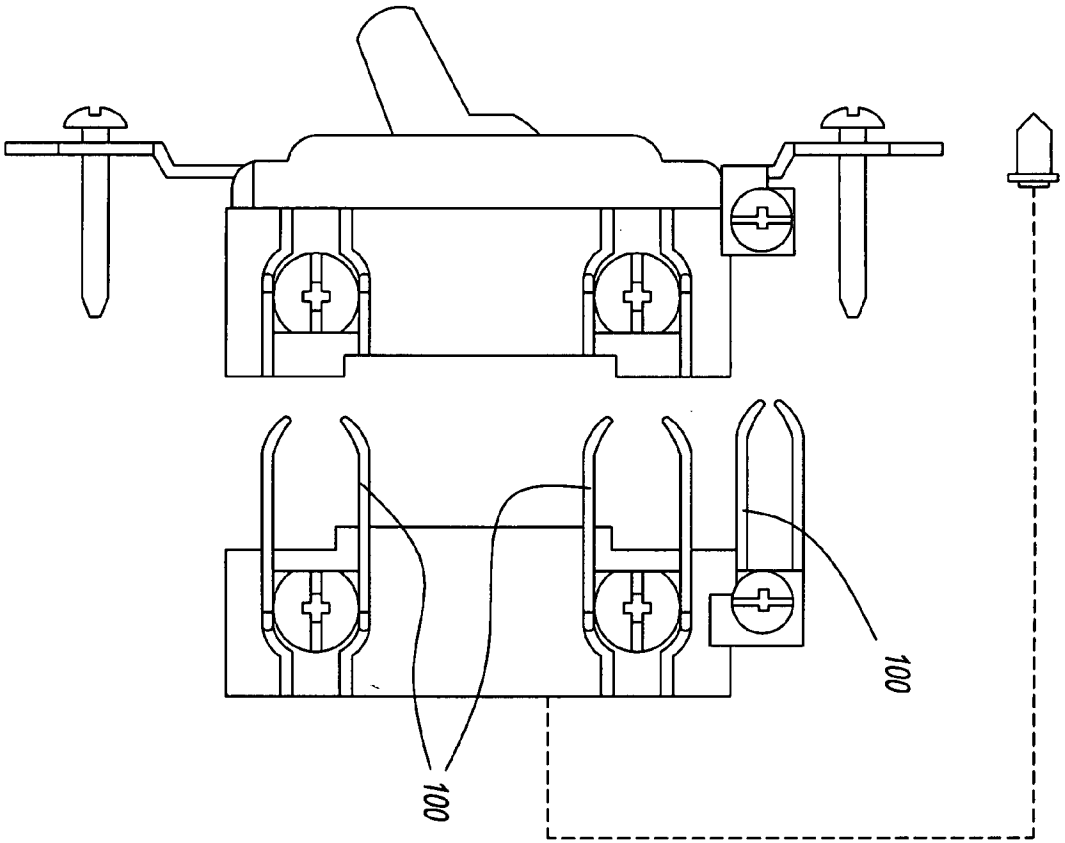
FIG. 1 shows the invention as a separate assembly.
Figure 2:
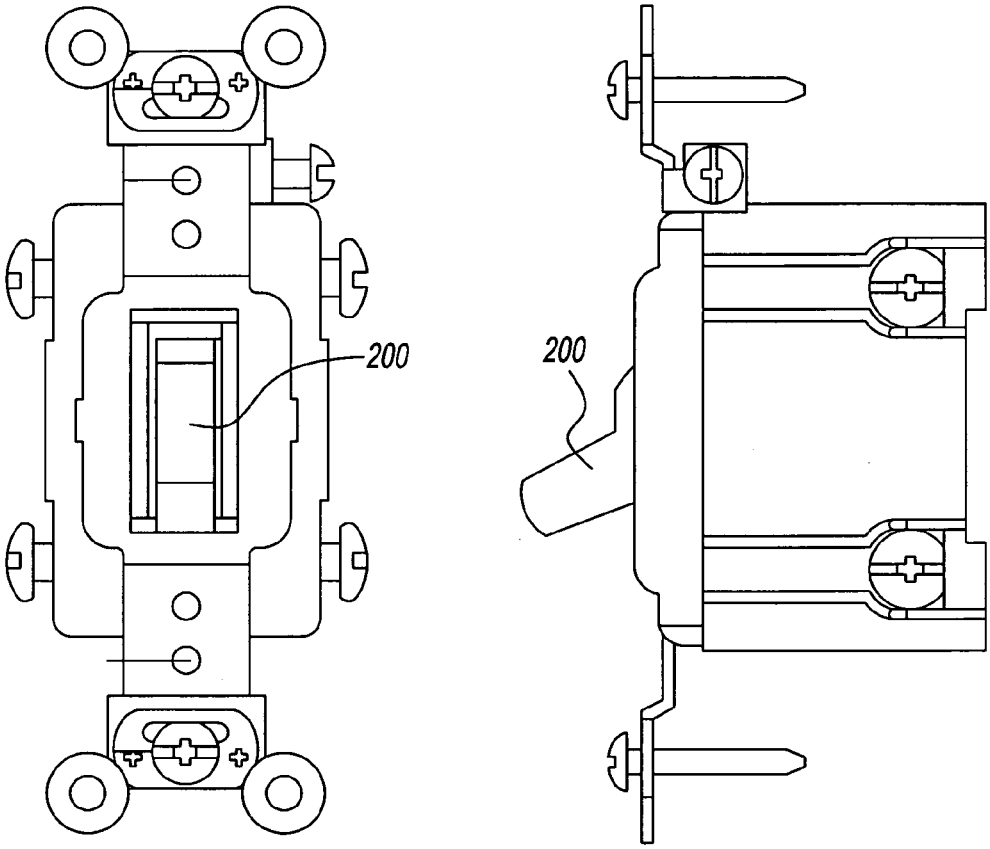
FIG. 2 shows the invention as a combination unit, integrated into the housing of a three-way or four-way switch.

The invention exists as either a separate assembly or as a combination unit. FIG. 1 shows the invention as a separate assembly. As a separate assembly, the invention can be situated in the space between the switch housing and the back of the electrical gang box, and connects to the terminals of the three-way or four-way switch by conductive metal tabs 100 or other conductive means. FIG. 2 shows the invention as a combination unit integrated into the housing of the three-way or four-way switch and connected to the switch's terminals internally.

The invention can be incorporated into all types of three-way and four-way switches: rotary, rocker, toggle, timer, photoelectric, single-button or double-button, dimmer, touch switches, or other types of three-way and four-way switches.

There are three different wiring configurations for circuits using three-way and four-way switches. All three wiring configurations use two three-way switches and any number of four-way switches in their circuits.

In wiring configuration #1, the most popular wiring configuration, the AC mains line ("hot") is fed into the "common" terminal of one of the three-way switches; the switches are connected through the other two terminals, the L1 terminals and L2 terminals, and finally a feed to the load is taken from the "common" terminal of the second three-way switch. To complete the circuit, the neutral wire, external to the switch, is run from the line to the load, either using a single wire or multiple wires typically connected in each switch's gang box. Any number of intermediate four-way switches can be inserted between the three-way switches, connected between the L1 terminals and L2 terminals of the three-way switches. Wiring configuration #1 is used in over 90% of all three-way and four-way switch circuits.

In wiring configuration #2, a circuit with two switches joins the three terminals of one three-way switch to the corresponding terminals on the other three-way switch and connects the AC mains line to the L1 terminals and the load to the L2 terminals (or vice versa). To complete the circuit, the neutral wire, external to the switch, is run from the line to the load. Any number of intermediate four-way switches can be inserted between the three-way switches, connected to the L1 terminals and L2 terminals; when four-way switches are added, the "common" terminals on the two three-way switches remain connected to each other. Wiring configuration #2 is used in under 10% of all three-way and four-way switch circuits.

In wiring configuration #3, the AC mains line ("hot") and the neutral wires are present in each switch, connected to both L1 terminals and L2 terminals respectively. The load is connected between the two "common" terminals of the two three-way switches. Any number of intermediate four-way switches can be inserted between the three-way switches, connected to the L1 terminals and L2 terminals. Wiring configuration #3 is used in under 1% of all three-way and four-way switch circuits.

Figure 3:
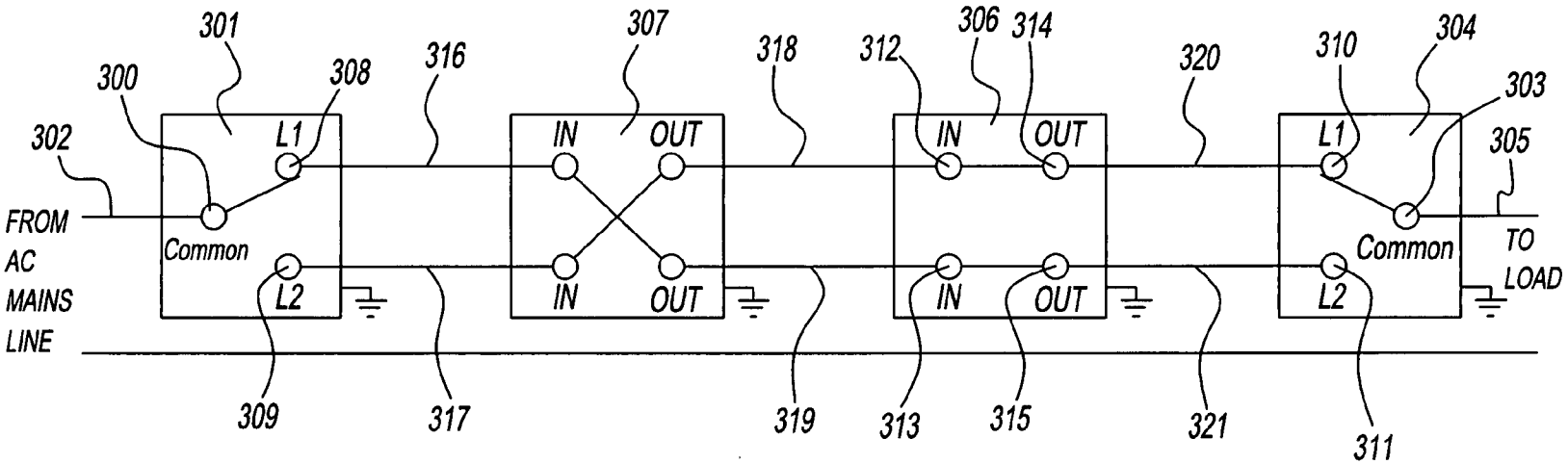
FIG. 3 (PRIOR ART)
FIG. 3 shows a typical electrical circuit with three-way and four-way switches.

Referring to FIG. 3, in an energized electrical circuit containing three-way or three-way and four-way switches using wiring configuration #1, with the "common" terminal 300 of the line-side three-way switch 301 connected to the AC mains line 302 and the "common" terminal 303 of the load side three-way switch 304 connected to the load 305, with any number of optional four-way switches 306, 307 between the three-way switches, voltage will be present on one of the L1 terminal 308 or the L2 terminal 309 of the line-side three-way switch 301 at all times and voltage will not be present on the other terminal, voltage will be present on one of the L1 terminal 310 or the L2 terminal 311 of the load-side three-way switch 304 at all times and voltage will not be present on the other terminal. On a four-way switch 306, voltage will always be present on one terminal 313 of the two input terminals 312, 313 and voltage will always be present on one terminal 315 of the two output terminals 314, 315, and voltage will not present on the other input terminal 312 and voltage will not be present on the other output terminal 314. Which terminals have voltage and which do not, depend on the positions of all of the switches in the electrical circuit. When any switch in the electrical circuit is toggled, the terminals with voltage on any switch in the electrical circuit can change. Therefore there is no single point or set of points within any particular switch that could be tapped to consistently and reliably indicate whether voltage is being delivered to the load. Hence, three-way and four-way switches in a circuit using conventional electrical wiring, able to provide an indication at any switch in the electrical circuit when voltage is being supplied to the load, as taught by the present invention, is novel.

In an energized electrical circuit containing three-way or three-way and four-way switches using wiring configuration #1, if the "common" terminal on the three-way switch adjacent to the load has voltage, voltage is being provided to the load. This information must then be communicated to all other switches in the electrical circuit. A "load status detector" will be used to determine whether the "common" terminal on the three-way switch adjacent to the load has voltage.

In circuits using wiring configurations #2, both the line and load connections are each present on at least one terminal on all switches in the electrical circuit. Whether voltage is being provided to the load can therefore be determined at each switch by identifying and testing a load terminal on any switch in the electrical circuit for voltage and using that information to directly or indirectly power the indicator at each switch. Since voltage will always be present on the line terminals of each switch, a rule for wiring configurations #2 is that if both the L1 terminal and the L2 terminal on a three-way switch have voltage, voltage is being supplied to the load. If only one of the L1 terminal or the L2 terminal has voltage, voltage is not being supplied to the load. On a four-way switch if both input terminals (or both output terminals) have voltage, voltage is being supplied to the load. If only one input terminal (or one output terminal) has voltage, voltage is not being supplied to the load.

In circuits using wiring configurations #3, voltage is being supplied to the load if the line ("hot") is present on the "common" terminal of the one three-way switch while "neutral" is simultaneously present on the "common" terminal of the other three-way switch.

Wiring configurations can be manually identified to the invention using a three-position slider switch present on each of the invention's three-way and four-way switch housings or wiring configurations can be determined by microprocessor means. In the load status preferred embodiment, the microprocessor contained on the invention assembly in each switch will identify the circuit's wiring configuration.

In wiring configuration #1, traveler wires or "travelers" are the two wires running between three-way and three-way switches, three-way and four-way switches, and four-way and four-way switches. In a circuit containing only two three-way switches, the L1 terminal and the L2 terminal of the three-way switches are connected to the same single pair of traveler wires. As shown in FIG. 3, a wiring diagram for an electrical circuit containing three-way and four-way switches using wiring configuration #1, a four-way switch 307 is connected to four traveler wires—two traveler wires 316, 317 connected to the input terminals and two traveler wires 318, 319 connected to the output terminals. Depending on the positions of all of the switches in the electrical circuit, one traveler 321 on a three-way switch 304 is always carrying line voltage and the other traveler 320 is not carrying line voltage. On a four-way switch 307, one "in" traveler 316 is always carrying line voltage and the other "in" traveler 317 is not carrying line voltage; one "out" traveler 319 is always carrying line voltage and the other "out" traveler 318 is not carrying line voltage. When any switch in the electrical circuit is toggled, the travelers carrying voltage can change, but one of the two travelers connected to a three-way switch will always carry line voltage and two travelers of the four travelers connected to a four-way switch will always carry line voltage.

Figure 4A:
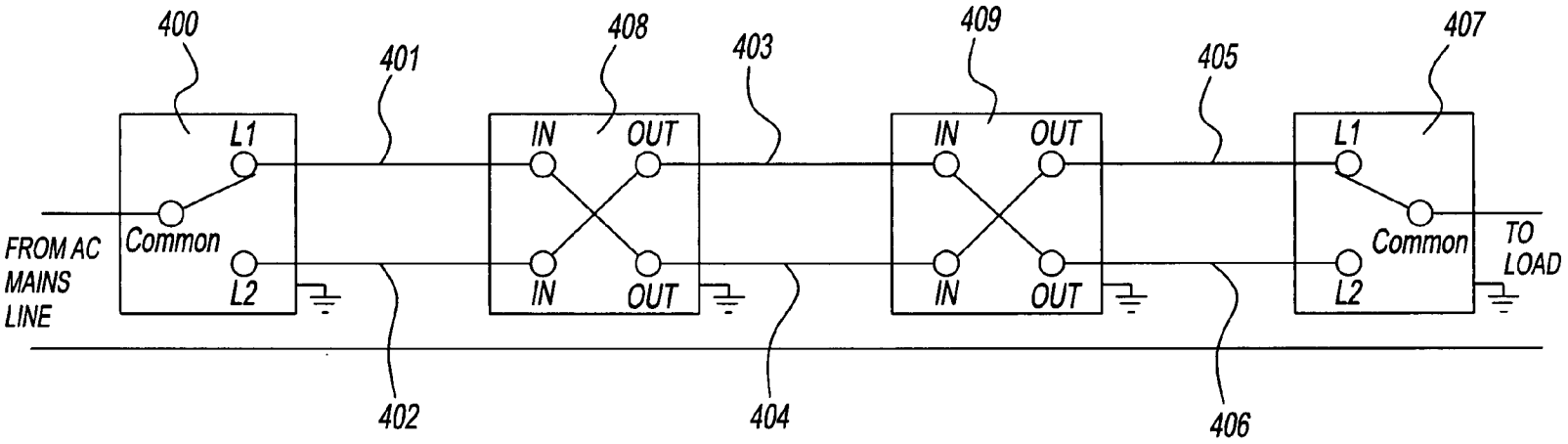
FIG. 4A (PRIOR ART)
FIG. 4A shows one configuration of the isolated signal channel connecting all switches.

As shown in FIG. 4A, when one traveler 401 of the pair of traveler wires 401, 402 between switches is carrying voltage, the other traveler 402 of the pair is not carrying voltage. The traveler 402 that is not connected to the voltage source, is connected to all of the other three-way and four way switches in the electrical circuit via all of the other traveler wires 403, 406 in the electrical circuit that are not carrying voltage.

Figure 4B:
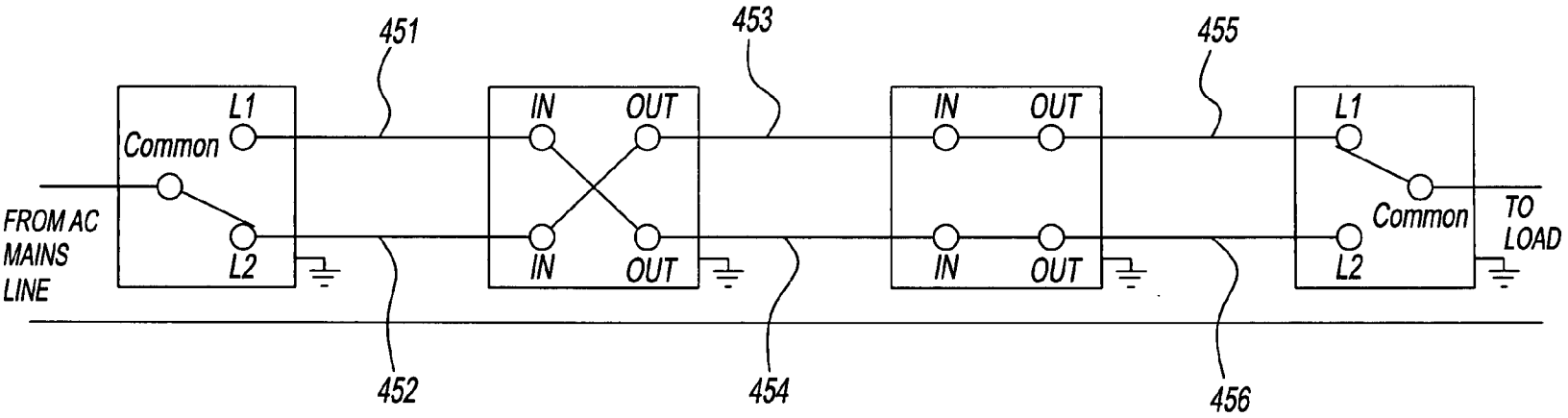
FIG. 4B (PRIOR ART)
FIG. 4B shows a different configuration of the isolated signal channel.

When the electrical circuit is supplying voltage to the load, this connection 402, 403, 406 from the line-side three-way switch 400 to the load-side three-way switch 407, with a number of four-way switches 408, 409 between, is isolated from the all other aspects of this circuit and any other circuit. The composition of this connection changes with the toggle of each switch in the electrical circuit, but always exists. FIG. 4A shows one composition of the isolated connection 402, 403, 406 while FIG. 4B shows another composition of the isolated connection 451, 454, 456. This isolated connection is heretofore unused for any purpose.

In the preferred embodiments, these isolated series of traveler wires connected to each switch and not connected to the power source or anything else, along with a return path connection such as a neutral or a ground connection, are used to communicate when voltage is being supplied to the load from the load-side three-way switch to all other switches in the electrical circuit. As such, no additional wiring between the switches is required for the invention to work. As the composition of the connection changes with each toggle of any switch in the electrical circuit, the invention "intelligently" identifies the series of unused wires, collectively called the "signal channel", from one three-way switch to the other three-way switch through any and all intermediate four-way switches. Since communications occurs using the isolated traveler wires, a set of switches on one electrical circuit will not respond to a signal meant for another set of switches in another circuit. As such, there is no need to set unique house or unit codes on the switches to distinguish them from other switches or groups of switches; the signals in each circuit are isolated from other circuits and only respond within their own circuit, an advantage over power line communication technology such as X-10.

Figure 5A:
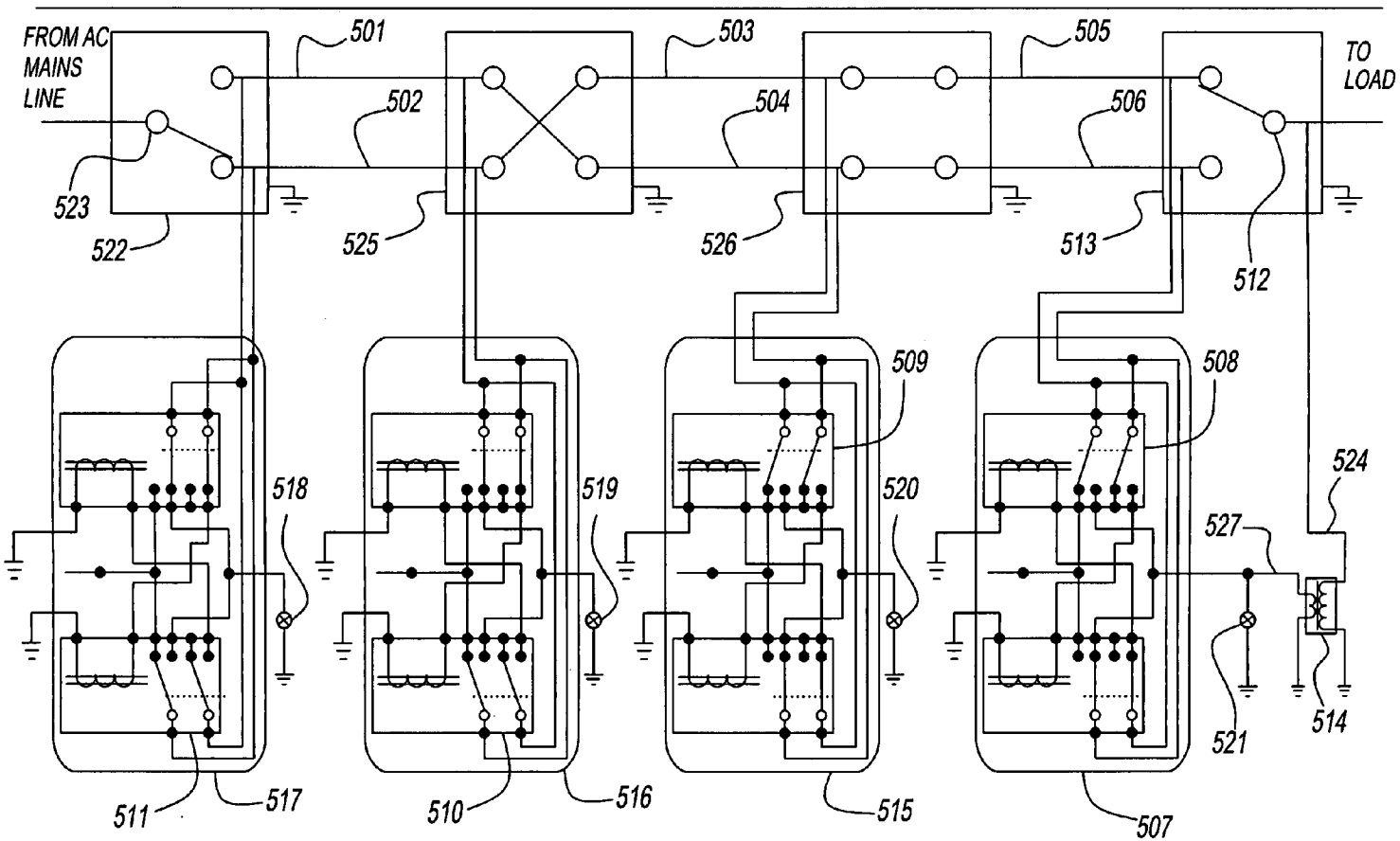
FIG. 5A shows an embodiment of the invention with AC voltage derived from the load-side three-way switch powering the indicators in all switches.
Figure 5B:
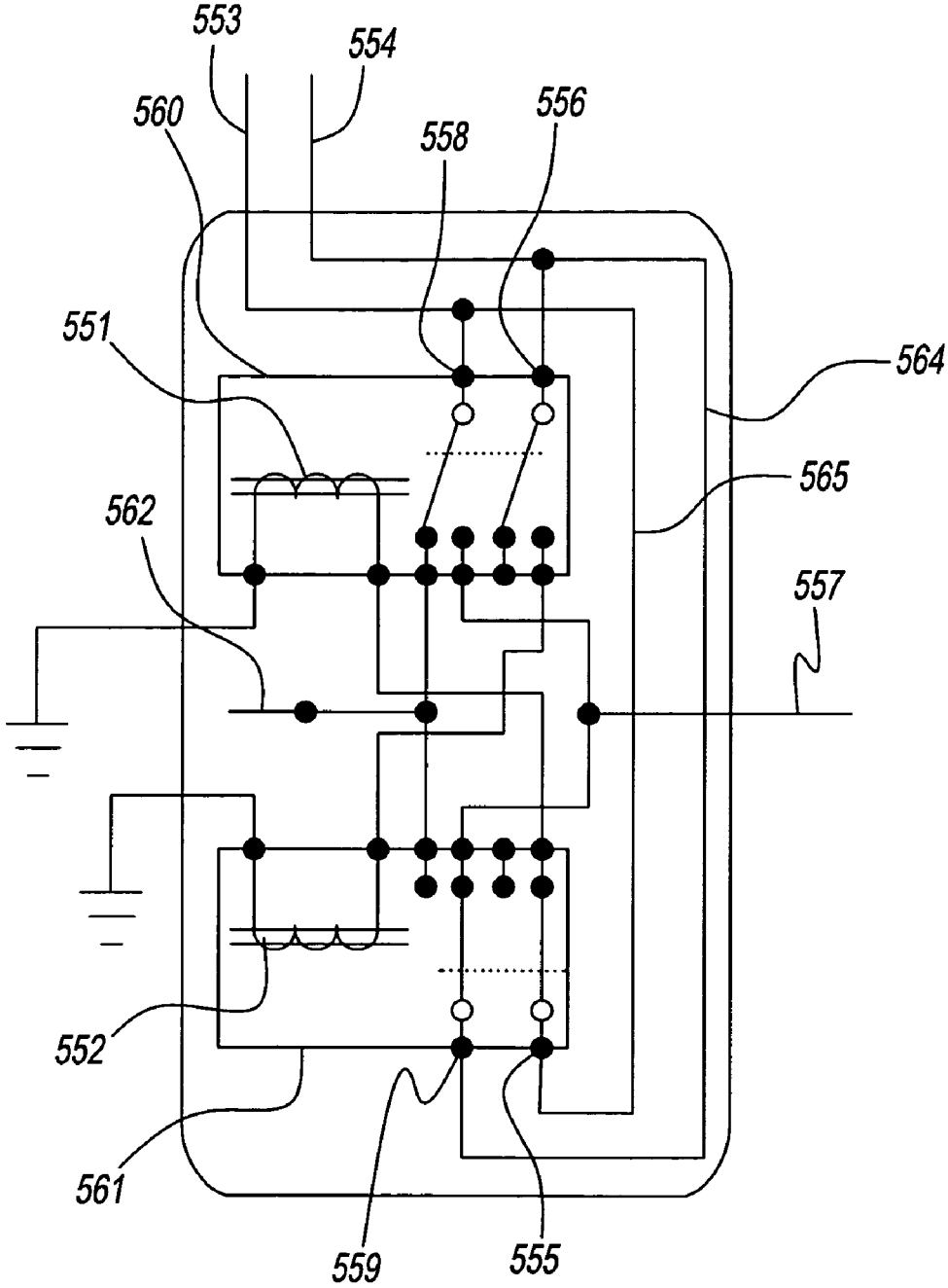
FIG. 5B shows the channel selector.

FIG. 5A shows a first three-way switch 522 having a common terminal 523 coupled to a hot conductor of the mains line, a last three-way switch 513 having a common terminal 512 coupled to the load, and two four-way switches 525, 526. Each switch in the electrical circuit is connected to a next switch by a first traveler wire 501, 503, 505 and a second traveler wire 502, 504, 506. A signal generator, in this embodiment comprising transformer 514, generates an AC voltage signal (e.g. 24 VAC) on the output 527 in response to a condition—AC mains voltage being present on the input 524. A signal generator channel selector 507, shown in greater detail in FIG. 5B, comprises a voltage detector and a signal generator channel selector switch. In this embodiment the voltage detector comprises actuators 551, 552 of mechanical relays 560, 561; an input, conductor 565, coupled to the first traveler wire 553 and an input, conductor 564, coupled to the second traveler wire 554; and an output, an electromagnetic field generated by actuator 551 and capable of engaging movable contacts 556, 558 in first relay 560 when AC mains voltage is present on first traveler wire 553, or generated by actuator 552 and capable of engaging movable contacts 555, 559 in second relay 561 when AC mains voltage is present on second traveler wire 554. In this embodiment the signal generator channel selector switch comprises the movable contacts 556, 558 in first relay 560, actuated by a control input, actuator 551, when AC mains voltage is present on first traveler wire 553, and the movable contacts 555, 559 in second relay 561, actuated by a control input, actuator 552, when AC mains voltage is present on second traveler wire 554; a signal input, conductor 557, coupled to the signal generator, transformer 514; a first signal output, conductor 565, coupled to the first traveler wire 553 and a second signal output, conductor 564, coupled to the second traveler wire 554. In the invention assemblies that are not in the load-side three-way switch, FIG. 5A shows signal detecting channel selectors 515, 516, 517. Each signal detecting channel selector comprises a voltage detector and a signal detecting channel selector switch. Functioning substantially similar to the voltage detector in the signal generator channel selector and the signal generator channel selector switch described above, in each of the invention assemblies that is not in the load-side three-way switch, the voltage detector in the signal detecting channel selectors detect which of the first traveler wire or the second traveler wire is connected to the AC mains line, and the signal detecting channel selector switches cause the first traveler wire or the second traveler wire that is not connected to the AC mains line to connect to the signal. The signal is coupled to a signal detector, in this embodiment, comprising indicator lights 518, 519, 520, 521. As used herein, the terms "signal generator channel selector switch" and "signal generating channel selector switch" are used interchangeably, and the terms "signal detecting channel selector switch" and "signal detector channel selector switch" are used interchangeably. As shown in the example of FIG. 5B, the voltage detector input, conductor 565, coupled to the first traveler wire 553 has mains voltage present resulting in the voltage detector, actuator 551 of first relay 560, being actuated; and movable contacts 556, 558 in first relay 560 are engaged resulting in the AC voltage signal (e.g. 24 VAC) traveling to the second traveler wire 554 via the second signal output, conductor 564, coupled thereto.

Referring to FIG. 5A, in order to identify and isolate the series of unused travelers without voltage 501, 504, 506 (the "signal channel"), from travelers containing line voltage 502, 503, 505 (the "AC mains channel"), two double-pole double-throw (DPDT) relays are used within each switch. Solid state relays (SSRs) containing no moving parts could be used instead of the mechanical relays. These relays or SSRs and the associated wiring are called the "channel selector". Whereas this task could be accomplished with a single-pole double-throw (SPDT) relay, a second relay is used as a cutoff to keep the signal channel completely isolated from the relay coil. Line voltage on one traveler 502, 503, 505 of each of the pair of traveler wires in the electrical circuit causes one of the relays 508, 509, 510, 511 in the channel selector 507 515 516 517 in each switch to engage. This process connects the other traveler wire 501, 504, 506 of the pair to the signal source, forming the signal channel.

More specifically, if mechanical relays are used in the channel selector, each of the two relays have a coil and double-pole double-throw contacts. If SSRs are used in the channel selector, each of the two SSRs have internal LED/photo-sensitive diodes to actuate the double-pole double-throw contacts. The term "actuator" will refer to both the coil in a mechanical relays and the LED/photo-sensitive diode in an SSR. Referring to FIG. 5B, the actuator 551 of the first relay 560 is connected to the first traveler wire 553 through a normally closed contact 555 of the second relay 561, and the actuator 552 of the second relay 561 is connected to the second traveler wire 554 through a normally closed contact 556 of the first relay 560. Depending on whether the invention assembly is sending or receiving the communication, either the signal generator or the signal detector is connected via a conductor 557 to the second traveler wire 554 through a normally closed contact 559 of the second relay 561, and is also connected to the first traveler wire 553 through a normally closed contact 558 of the first relay 560 such that when voltage from the hot conductor of the mains line is present on the first traveler wire 553, the actuator 551 of the first relay 560 is actuated, and the signal generator or the signal detector is connected via the conductor 557 to the second traveler wire 554 via the normally closed contact 559 of the second relay 561 and disconnected from the first traveler wire 553 via the normally closed contact 558 of the first relay, and when voltage from the hot conductor of the mains line is present on the second traveler wire 554 the actuator 552 of the second relay 561 is actuated, and the signal generator or the signal detector is connected via a conductor 557 to the first traveler wire 553 via the normally closed contact 558 of the first relay and disconnected from the second traveler wire 554 via the normally closed contact 559 of the second relay 561.

The actuators of the channel selector relays act as "voltage detectors" such that when line voltage exists on the first traveler wire, the actuator of the first relay causes the signal generator or the signal detector to be connected only to the second traveler wire, and when line voltage exists on the second traveler wire, the actuator of the second relay causes the signal generator or the signal detector to be connected only to the to the first traveler wire.

In the preferred embodiments, power is supplied to the invention's indicator and logic circuit using the voltage passing through the switch. As voltage switches from one terminal to another in a switch as a result of a switch in the electrical circuit being toggled, the invention will always receive power from a terminal containing voltage.

Referring to FIG. 5B, voltage always exists on the "power terminal" 562 to power the invention assemblies. When the first relay 560 is actuated as a result of voltage being present on the first traveler 553, normally closed contact 558 of the first relay 560 connects the first traveler 553 to power terminal 562. When the second relay 561 is actuated as a result of voltage being present on the second traveler 554, normally closed contact 559 of the second relay 561 connects the second traveler 554 to power terminal 562. Hence power terminal 562 always has voltage to power the invention assemblies.

Each invention assembly has one channel selector. For descriptive purposes the channel selector may be referred to as the "signal generator channel selector" or the "signal detecting channel selector", depending on whether the particular invention assembly is facilitating a signal generation function (sending) or a signal detection function (receiving).

The first of the five communications that are the primary subject of the present invention is a communication from the load-side three-way switch to all other switches in the electrical circuit, communicating that voltage is being provided to the load, such that all switches activate a load status indicator at any switch with the invention assembly.

With this first communication, the present invention provides a means at any number of switches in an electrical circuit containing three-way or three-way and four-way switches, to indicate when voltage is being supplied to the electrical load on the circuit. The invention uses conventional wiring for three-way and four-way circuits, and does not require any additional wiring. If the electrical circuit is designed to provide voltage to an electrical fixture, the invention determines if voltage is being supplied to that fixture and provides an indicator at any switch in the electrical circuit showing whether the circuit is supplying voltage to the fixture.

The load status preferred embodiment of present invention uses an LED indicator controlled by microprocessor-based circuitry integrated within the three-way and four-way switches in an electrical circuit that uses conventional wiring for three-way and four-way switches. The indicators at any number of switches in the electrical circuit show when voltage is being supplied to the load. The invention is most useful in instances when observing the light in a circuit controlled by multiple switches, to determine whether the light is on or off, is not practical or desirable, either because the light is not visible from all switch locations or because several lights are within the view of the switch, some on and others off, and it is not apparent which light is controlled by which switch. In these instances, having the present invention's indicator on the switches in the electrical circuit, showing whether the light controlled by that switch is on or off, is useful.

The invention can be used to show the status of pool house lights or garage lights from the main home; or to show the status of basement lights from the first floor, without having to open the basement door to check whether the light is on or off. Using an audible indicator e.g. a tone generator that sounds a "beep", the invention can be used as a security device to indicate when a basement, pool house, or any light has been switched on or off. The tone can be one-time, continuous, intermittent, or periodic until disabled.

Using the invention, the process of turning off lights is no longer done in a trial an error manner, but rather those switches with a load status indicator illuminated are switched to the opposite position to remove the supply of voltage from the load. For visual and functional consistency within a house, the invention's three-way or four-way switches can be used to power electrical circuits that only require a standard SPST light switch. In these instances, the indicator will properly show when voltage is being supplied to the load.

The present invention can be incorporated into the electrical design plans for new construction and renovations and, since the invention uses conventional wiring for three-way and four-way electrical circuits, it can be used to replace three-way and four-way switches in existing electrical circuits, and properly indicate at any switch in the electrical circuit when voltage is being supplied to the electrical circuit's load. The terminal configuration of the three-way and four-way switches used by the invention is the same as standard three-way and four-way switches, and the wiring between switches is the same conventional wiring known to and used by electricians.

In the load status preferred embodiment the invention is integrated into the housing of the standard three-way or four-way wall switch and indicates when voltage is being supplied to the electrical load device on the circuit by way of a single light emitting diode (LED) indicator incorporated into the moveable toggle portion 200 of each switch as shown in FIG. 2; a glowing LED indicates that voltage is being supplied to the load.

Instead of a single LED turning on and off, the indicator could be one or more LEDs glowing different colors to indicate when voltage is being supplied to the load e.g. green could indicate that voltage is being supplied, while red could indicate that voltage is not being supplied; a small neon, incandescent, or fluorescent bulb could also be used as the indicator, that if the bulb is illuminated, voltage is being supplied to the load; a liquid crystal display (LCD) panel displaying letters, words or symbols to indicate if voltage is being supplied e.g., "ON", "OFF", "DR-OFF", "LR1-ON"; by audible means such as a single "beep", a continuous or an intermittent tone; by a synthesized or recorded voice; or by other means. The indicator could also be external to the switch housing, e.g., an LED affixed to the wall plate and connected to the switch by copper wire or other conductive means.

The indicator can be active on a continuous basis—"on" when voltage is being supplied, otherwise "off"; intermittently—a flashing LED or bulb, or a periodic audible tone; or the indicator may only be active when requested by external means such as the pressing of a button.

Although the purpose of the indicator is not to locate the switch in a dark room, but to indicate when the electrical load device on the electrical circuit is being supplied with voltage, by the indicator using "dim" and "normal" brightness levels rather than "on" and "off", the indicator would always be on and could then also serve to locate the switch in the dark. The circuit could also have the option of initializing the LED indicators on all switches in reverse, such that the indicator is "on" when the electrical circuit is NOT supplying voltage to the load and OFF when it IS supplying voltage to the load.

Communication occurs when either a voltage signal capable of illuminating the indicators in each switch (e.g. 24 VAC) is generated on the signal channel from the load-side three-way switch invention assembly when voltage is being supplied to the load; or a low voltage signal (e.g. +5 VDC) is generated from the load-side three-way switch invention assembly that communicates to the other switches in the electrical circuit that line voltage is being supplied to the load. With the latter approach, each switch in the electrical circuit containing the invention assembly detects the signal and provides power to the indicator at the switch. The signal could also be a modulated tone of a particular frequency, generated by a tone generator in the load-side three-way switch invention assembly that a tone detector in each of the other switch's invention assembly responds to, i.e., the presence of a continuous or periodic tone would mean the indicator should be "on". The tone would be inaudible, generated and detected only on the signal channel. The signal generation process could also use asynchronous communications or another digital communication protocol to send a series of +5 VDC and −5 VDC voltages representing bits (1's and 0's) on the isolated signal channel, information sent by the load-side three-way switch's invention assembly to be detected and interpreted by the invention assemblies in the other switches in the electrical circuit.

Referring to FIG. 5A, once this signal channel is identified, if voltage exists on the load-side "common" terminal 512, then voltage is being supplied to the load and a signal is generated on the signal channel. In one embodiment, the signal is an AC voltage derived from the "common" terminal 512 adjacent to the load on the load-side three-way switch 513. Using a transformer 514, a stepped-down voltage e.g., 24 VAC, will power the indicators on each switch directly. In this embodiment, the "signal generator" comprises transformer 514. The signal travels from the "signal generator channel selector" 507 to the "signal detecting channel selector" 515, 516, 517 in the invention assembly of all of the other switches in the electrical circuit. The channel selectors direct the signal to the "signal detectors", comprising indicator lights 518, 519, 520, 521 on the invention assembly in each switch in the electrical circuit. In this embodiment, the indicator is a neon lamp powered by the stepped-down voltage originating in the load-side three-way switch 513. When by toggling any switch in the electrical circuit the "common" terminal 512 on the load-side three-way 513 switch adjacent to the load no longer contains voltage, the AC source powering the indicators will no longer exist and the indicator lights will go off. In this embodiment, the transformer 514 acts as both the signal generator and the load status detector, and the neon lamp acts as the signal detector.

Figure 6:
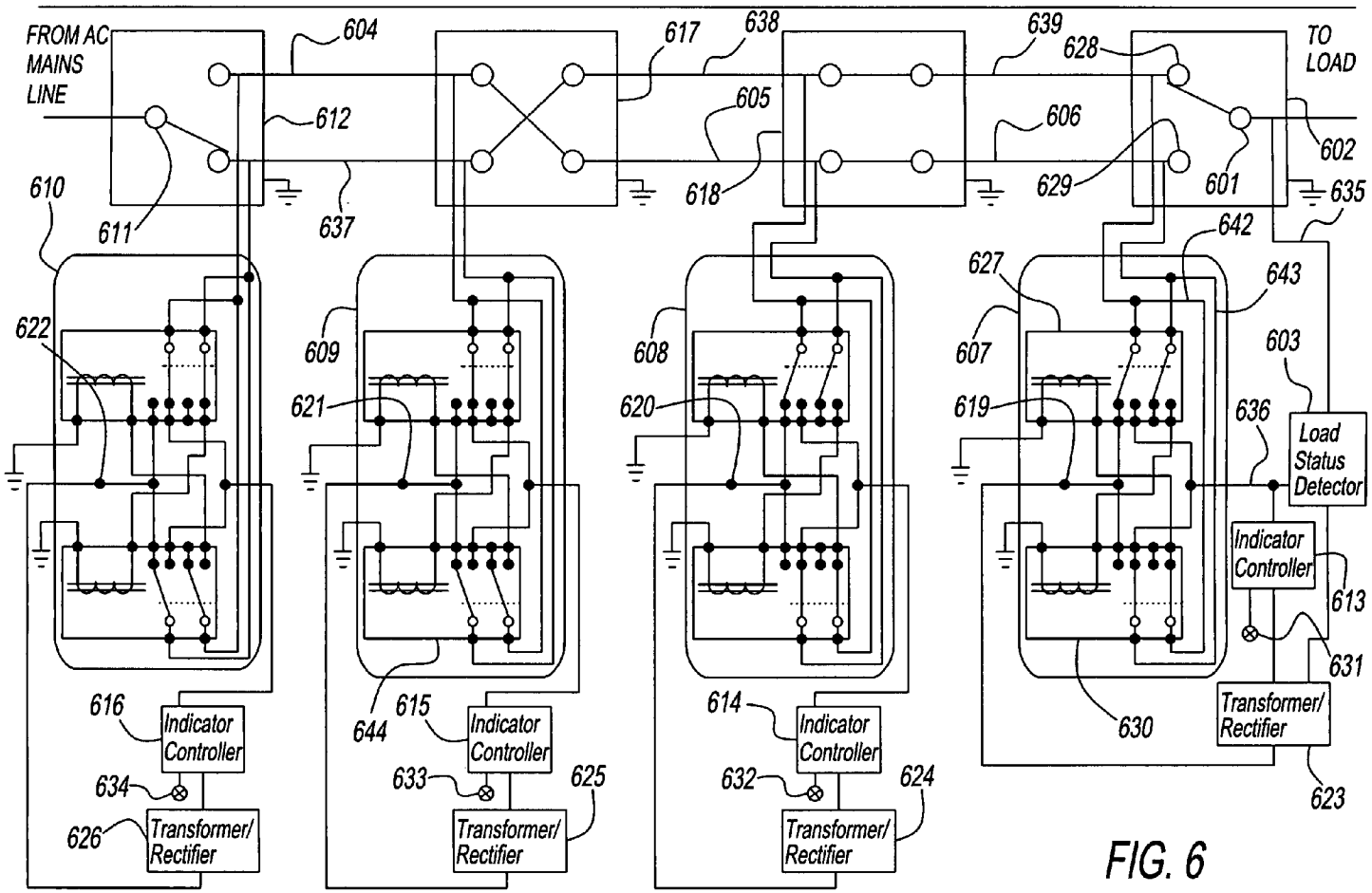
FIG. 6 shows an embodiment of the invention using a DC signal voltage to instruct the switches to illuminate the indicators.

In another embodiment, a DC signal voltage embodiment, as depicted in FIG. 6, the signal is a DC voltage derived from the "common" terminal 601 adjacent to the load on the load-side three-way switch 602. The "load status detector" 603 contains an opto-isolator which detects AC mains voltage on the high-voltage side and if AC mains voltage exists, outputs IC circuit voltage, typically +5 VDC, on the low voltage side. The "signal generator" comprises "load status detector" 603. If AC mains voltage exists on this terminal 601, voltage is being supplied to the load and a +5 VDC signal voltage is directed to the signal channel 604, 605, 606 via the "signal generator channel selector" 607, to the "signal detecting channel selectors" 608, 609, 610 to the "indicator controller" 613, 614, 615, 616 in the invention assembly on each switch, instructing the circuitry to power the indicator using voltage from the switch. The "signal detectors" comprise indicator controllers 613, 614, 615, 616.

When by toggling any switch in the electrical circuit the "common" terminal 601 in the load-side three-way switch 602 no longer contains voltage, the DC signal on the signal channel drops to 0 VDC, the "indicator controller" 613, 614, 615, 616 in each switch removes power to the indicator and the indicator lights 631, 632, 633, 634 go off. In this embodiment, the load status detector 603 acts as the signal generator, generating the low-voltage DC signal, and the indicator controller acts as the signal detector.

FIG. 6 shows a first three-way switch 612 having a common terminal 611 coupled to a hot conductor of the mains line, a last three-way switch 602 having a common terminal 601 coupled to the load, and two four-way switches 617, 618. Each switch in the electrical circuit is connected to a next switch by a first traveler wire 604, 638, 639 and a second traveler wire 637, 605, 639. A signal generator, in this embodiment comprising load status detector 603, generates a DC voltage signal (e.g. +5 VDC) on the output, conductor 636, in response to a condition—AC mains voltage being present on the input 635. A signal generator channel selector 607 comprises a voltage detector and a signal generator channel selector switch. In this embodiment the voltage detector comprises actuators of mechanical relays 627, 630; an input, conductor 642, coupled to the first traveler wire 639 and an input, conductor 643, coupled to the second traveler wire 606; and an output, an electromagnetic field generated by the actuator of first relay 627 and capable of engaging the movable contacts in first relay 627 when AC mains voltage is present on first traveler wire 639, or generated by actuator of second relay 630 and capable of engaging the movable contacts in second relay 630 when AC mains voltage is present on second traveler wire 606. In this embodiment, the signal generator channel selector switch comprises the movable contacts in first relay 627, actuated by a control input, the actuator in first relay 627 when AC mains voltage is present on first traveler wire 639, and the movable contacts in second relay 630, actuated by a control input, the actuator in second relay 630 when AC mains voltage is present on second traveler wire 606; a signal input, conductor 636, coupled to the signal generator, load status detector 603; a first signal output, conductor 642, coupled to the first traveler wire 639 and a second signal output, conductor 643, coupled to the second traveler wire 606. In the invention assemblies that are not in the load-side three-way switch, FIG. 6 shows signal detecting channel selectors 608, 609, 610. Each signal detecting channel selector comprises a voltage detector and a signal detecting channel selector switch. Functioning substantially similar to the voltage detector in the signal generator channel selector 607 and the signal generator channel selector switch described above, in each of the invention assemblies that is not in the load-side three-way switch, the voltage detector in the signal detecting channel selectors detect which of the first traveler wire or the second traveler wire is connected to the AC mains line, and the signal detecting channel selector switches cause the first traveler wire or the second traveler wire that is not connected to the AC mains line to connect to the signal. The signal is coupled to a signal detector, in this embodiment, comprising indicator controllers 613, 614, 615, 616 coupled to indicator lights 631, 632, 633, 634. As shown in the example of FIG. 6, the voltage detector input, conductor 642 of signal generator channel selector 607, coupled to the first traveler wire 639 detects that AC mains voltage is present, causing the voltage detector, the actuator of first relay 627, to actuate and movable contacts in first relay 627 being engaged, resulting in the DC voltage signal (e.g. +5 VDC) traveling to the second traveler wire 606 via the second signal output, conductor 643 coupled thereto. In the invention assemblies that are not in the load-side three-way switch, the example of FIG. 6 shows the voltage detector of signal detecting channel selector 609 detecting AC mains voltage on the second traveler wire 637 causing the signal detecting channel selector switch, the actuator of second relay 644, to connect the first traveler wire 604 to the signal. The signal is coupled to the signal detector comprising indicator controller 615 coupled to indicator light 633.

The invention assembly receives power from the channel selector. If line voltage exists on the L1 terminal 628 of the load-side three-way switch 602, one relay 627 in the "channel selector" 607 will engage sending voltage to a lead 619 which is connected through a transformer/rectifier circuit 623 as the invention assembly's power source. If after a toggle of a switch, line voltage existed on the L2 terminal 629, the second relay 630 would engage, also sending voltage to lead 619. Therefore in an energized electrical circuit, line voltage will always exist on lead 619, the "power terminal", to power the invention assembly. Power from the "power terminal" 619, 620, 621, 622 in the "channel selector" in each switch is always present and is used to power all IC circuitry in the switches via "transformer/rectifier" 623, 624, 625, 626.

The signal generation by the load-side three-way switch and the signal detection by the other switches in the electrical circuit, along with the process of illuminating and extinguishing the indicators can alternatively be facilitated by using a microprocessor.

Although both the load-side and the line-side three-way switches could contain signal generation means, these means are not be needed in the line-side three-way switch. The line-side signal generation means could be deactivated manually using a DIP switch on the line-side three-way switch, logic circuitry could be used to detect the constant voltage at the line-side "common" terminal and never engage the signal generation means, or the microprocessor could be responsible for generating the signal only from the three-way switch identified as the load-side three-way switch.

In the load status preferred embodiment, the presence of a voltage on the signal channel will instruct the invention to turn the indicators "on" and the absence of voltage on the signal channel will cause the invention to turn the indicators "off". Detecting the presence or absence of line voltage on the "common" terminal of the load-side three-way switch is facilitated by the use of a microprocessor.

A set of tasks needs to be performed for the invention to work. Specifically, after the circuit is energized, i.e. after voltage is supplied to the electrical circuit, the invention assembly in each switch (a) identifies a "hot" terminal on the switch to be used to power the invention's indicator and circuitry, (b) determines whether the switch is a three-way switch or a four-way switch, (c) determines which of the three wiring configurations the circuit is using, and (d) if the switch is a three-way switch, identifies whether it is the line-side three-way switch or the load-side three-way switch. Then, with each toggle of any switch in the electrical circuit, (e) if the switch is the load-side three-way switch, determines whether voltage is being supplied to the load, (f) all switches isolate the traveler wires attached to the switch that comprise the signal channel, (g) if the switch is the load-side three-way switch, generates a signal when voltage is being supplied to the load, (h) if the switch is not the load-side three-way switch, recognizes the presence of the signal being sent by the load-side three-way switch, and (i) illuminates or extinguishes the switch's indicator light responsive to the presence or absence of the signal on the signal channel sent by the load-side three-way switch.

All of these tasks can be performed by or facilitated by the use of a microprocessor device. Each task will translate into a series of instructions to be carried out by the microprocessors in the invention assembly in each switch. These tasks and their underlying instructions are one example of an approach to accomplish the goal of each switch in a circuit indicating when voltage is being supplied to the circuit's load; other tasks and instructions could accomplish the same goal.

Figure 7:
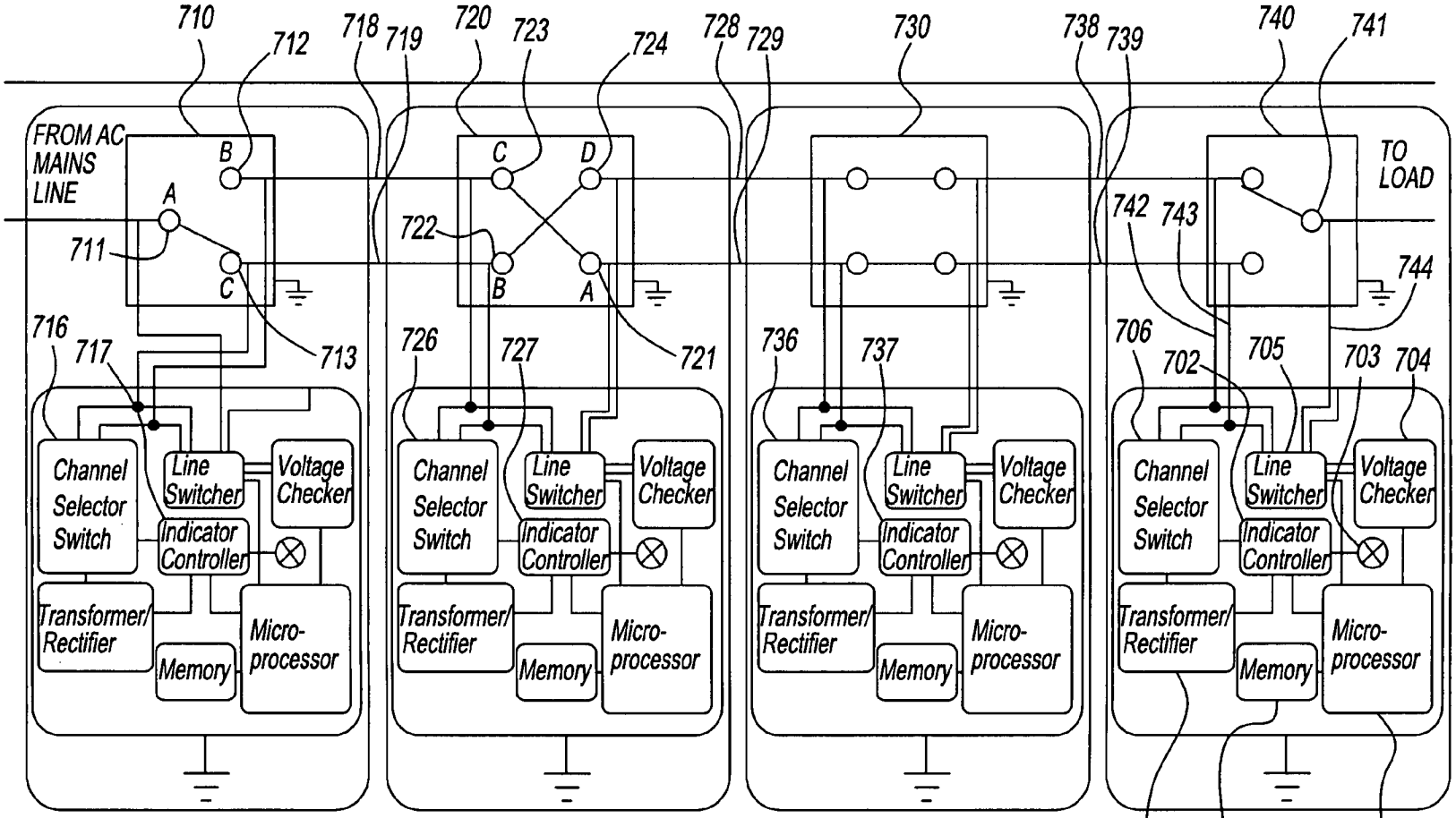
FIG. 7 shows the load status preferred embodiment of the invention using a microprocessor.

In the microprocessor embodiment, as depicted in FIG. 7, the invention assembly within each switch comprises a logic circuit board with a logic processor, such as a microprocessor 700; one or more memory components 701 containing logical coding instructions; an indicator controller 702 that, responding to a detection signal, illuminates an indicator 703; a voltage checker circuit 704 comprising an opto-isolator for detecting AC mains line voltage; a line switcher 705 circuit, under microprocessor control capable of connecting each of a three-way or four-way switch's terminals to various test points within the electrical circuit; a channel selector switch 706 comprising mechanical or solid state relays to isolate one traveler wire within each pair of traveler wires as part of the signal channel, and the other traveler wire as the power source for the invention assembly; a transformer/rectifier circuit 707 to provide IC circuit voltage to the invention assembly from the power source; and other integrated circuit components.

Connectors from the invention's logic circuit board are attached to all of the terminals on the switch, either internally if the invention is integrated into switch's housing, or externally using conductive metal tabs when the invention is a self-contained assembly external to the switch. Three connections are made to the three terminals on a three-way switch or four connections are made to the four terminals on a four-way switch.

FIG. 7 shows a first three-way switch 710 having a common terminal 711 coupled to a hot conductor of the mains line, a last three-way switch 740 having a common terminal 741 coupled to the load, and two four-way switches 720, 730. Each switch in the electrical circuit is connected to a next switch by a first traveler wire 718, 728, 738 and a second traveler wire 719, 729, 739. The microprocessor-based embodiment comprises a signal generator capable of generating a DC voltage signal (e.g. +5 VDC), the signal generator comprising microprocessor 700 capable of instructing line switcher 705 to connect an input 744 to voltage checker 704 to test for a condition, AC mains voltage being present on the input; input 744; and an output, a unique data storage location in memory 701 that stores data indicative of whether AC mains voltage is present on the input 744. On the load-side three-way switch, the microprocessor-based embodiment further comprises a signal generator channel selector comprising a voltage detector and a signal generator channel selector switch. The voltage detector comprises microprocessor 700 capable of instructing line switcher 705 to connect voltage checker 704 to each of two inputs to test for the presence of AC mains voltage; an input, conductor 742, coupled to the first traveler wire 738; an input, conductor 743, coupled to the second traveler wire 739; and an output, a unique data storage location in memory 701 that stores data indicative of which of the first traveler wire 738 or the second traveler wire 739 is not connected to the AC mains line. The signal generator channel selector switch 706 comprises a control input, the unique data storage location in memory 701 that stores data indicative of whether AC mains voltage is present on the voltage detector input 744; a signal input, the unique data storage location in memory 701 that stores data indicative of which of the first traveler wire 738 or the second traveler wire 739 is not connected to the AC mains line; a first signal output, conductor 742, coupled to the first traveler wire 738; and a second signal output, conductor 743, coupled to the second traveler wire 739, such that if voltage is detected on input 744 of the voltage detector, microprocessor 700 instructs the signal generator channel selector switch 706 to connect the DC voltage signal (e.g. +5 VDC) to whichever of the first traveler wire or the second traveler wire is not connected to AC mains voltage. In the invention assemblies that are not in the load-side three-way switch, FIG. 7 shows signal detecting channel selectors comprising voltage detectors, comprising microprocessors capable of instructing the line switchers to connect the voltage checkers to each of two inputs to test for the presence of AC mains voltage; and signal generator channel selector switches. Functioning substantially similar to the signal generator channel selector of the load-side three-way switch described above, in each of the invention assemblies that is not in the load-side three-way switch, under microprocessor instruction, the voltage detectors in the signal detecting channel selectors detect which of the first traveler wire or the second traveler wire is connected to the AC mains line, and under microprocessor instruction, the signal detecting channel selector switches 716, 726, 736 cause the first traveler wire or the second traveler wire that is not connected to the AC mains line to connect to the signal. The signal is coupled to signal detectors, in this microprocessor-based embodiment, comprising indicator controllers 717, 727, 737, 702, each coupled to indicator lights.

In the microprocessor-based embodiment, when the electrical circuit is energized, the invention's logic circuit in each switch initializes, performing tasks (a) through (d) above. The indicators on each switch could flash until tasks (a) through (d) are completed. After the toggle of any switch in the electrical circuit, tasks (e) through (i) above are performed after which the indicators on all switches in the electrical circuit show when voltage is being supplied to the load device; the indicator is "on" if the electrical circuit is supplying voltage to the load and "off" if the electrical circuit is NOT supplying voltage to the load. If the indicators are on, placing any switch in the opposite position will remove voltage from the electrical load device on the circuit and the indicator lights on every switch in the electrical circuit will go off. When any switch is toggled again, reapplying voltage to the load, all indicator lights on the switches within the electrical circuit will re-illuminate.

In the microprocessor-based embodiment, task (a), identifying a "hot" terminal on each switch, is accomplished by the "channel selector" 706. As in the DC Signal Voltage embodiment, using two relays with double-pole double-throw contacts, power is always available on the "power terminal" to power the circuitry in each switch.

Referring to FIG. 7, several of the remaining tasks can be facilitated by a "line switcher" 705 circuit assembly. Under microprocessor 700 control, the "line switcher" 705 assembly can direct each of the electrical switch's terminals to the opto-isolator in the "voltage detector" to test for the presence of 120 VAC on any of the terminals of the three-way or four-way switch. Absent 120 VAC, the "line switcher" assembly can test for continuity between any two terminals and between any terminal and ground. The microprocessor 700 instructs the "line switcher" 705 assembly, which uses mechanical relays, SSRs or other means, to connect any of the switch's terminals to each other or to ground. Continuity between two terminals is determined by originating a low voltage at one terminal and if continuity exists, detecting the presence of that voltage at another terminal.

Task (b), identifying whether a switch is a three-way switch or a four way switch, can be accomplished using the "line switcher" circuit to test for voltage and continuity. As shown in FIG. 7, a three-way switch 710 has three terminals 711, 712, 713 labeled A, B and C, and a four-way switch 720 has four terminals 721, 722, 723, 724 labeled A, B, C and D. Terminal D is not used on a three-way switch. For both as an external device and as an integrated assembly within a switch housing, if the terminal connected to the invention assembly as terminal D has line voltage on it, the terminal is "in use" and the switch is known to be a four-way switch. Absent line voltage, if any switch has electrical continuity between the terminal D and either terminal B or terminal C, the terminal is "in use" and the switch is known to be a four-way switch. If the terminal D does not have line voltage and is not connected to either terminal B or terminal C, the switch is a three-way switch. This method allows for a four-way switch to be used as a three-way switch and to be recognized as a three-way switch. Similarly, either a three-way switch or a four-way switch can be used as and operate as a standard SPST wall switch.

Task (c), determining which wiring configuration the circuit is using, can be accomplished after a single toggle of any switch in the energized circuit. If voltage is detected on either of the L1 terminal or the L2 terminal of a three-way switch prior to the first toggle and voltage is detected on the other terminal after the first toggle, the circuit is using wiring configuration #1. If voltage is detected on one terminal pair on a four-way switch prior to the first toggle and voltage is detected on an opposite pair after the first toggle (e.g. A-B prior and A-C after or D-B prior and D-C after), the circuit is using wiring configuration #1. If voltage is detected on both the L1 terminal and the L2 terminal of a three-way switch either prior to the first toggle or after the first toggle, the circuit is using wiring configuration #2. If voltage is detected on all four terminals on a four-way switch either prior to the first toggle or after the first toggle, the circuit is using wiring configuration #2. If continuity to ground is detected on any terminal that does not have voltage, either prior to the first toggle or after the first toggle in a three-way or four-way switch, the circuit is using wiring configuration #3. These are one set of tests that can be used to determine the circuit's wiring configuration. Other tests will also work.

After a single toggle of any switch in the electrical circuit, each switch can determine the circuit's wiring configuration. In addition, in wiring configuration #2, the same process that determines the wiring configuration can also determine whether voltage is being supplied to the load since in wiring configuration #2 the load terminal is present on all switches in the electrical circuit—if voltage exists on both the L1 terminal and the L2 terminal of a three-way switch or on all four terminals of a four-way switch, voltage is being provided to the load. Alternatively, in wiring configuration #2 an isolated signal channel between all switches only exists when voltage is not being supplied to the load. Hence, when the microprocessors detects wiring configuration #2, a rule for indicating that voltage is being supplied to the load could be to communicate and receive a signal when voltage is not being supplied to the load, illuminating the indicator in the absence of a signal and extinguishing the indicator in the presence of a voltage signal.

For each switch to accomplish tasks (b) and (c), it will be necessary to know that a toggle of another switch in the electrical circuit has taken place. With wiring configuration #1, there will be occasions when a switch will not be able to determine that a toggle of another switch in the electrical circuit has taken place because the voltages on all of the switch's terminals will remain the same before and after the toggle. Since the load-side three-way switch always "knows" when a toggle takes place, the load-side three-way switch will inform all switches of a toggle taking place using a unique signal on the signal channel immediately following the initial toggle of a switch after the circuit has been energized. Any switch in the electrical circuit that has not completed tasks (b) and (c) will "listen" for the unique signal. This will only be necessary until all switches can determine whether they are a three-way or a four-way switch (or more accurately, how they are being used in the electrical circuit) and which wiring configuration the circuit is using.

Task (d), determining whether a three-way switch is the load-side or line-side three-way switch, can be accomplished after a single toggle of any switch. There are only two three-way switches in a circuit, the line-side three-way switch 710 and the load-side three-way switch 740. The "common" terminal 711 on the line-side three-way switch 710 is connected to AC mains and will therefore always have line voltage. The "common" terminal 741 on the line-side three-way switch 740 will only have line voltage when voltage is being supplied to the load. Therefore, if voltage is detected on the common terminal of a three-way switch both prior to the first toggle and after the first toggle, the three-way switch is the line-side three-way switch. Whereas if voltage is detected on the common terminal of a three-way switch either prior to the first toggle or after the first toggle, but not on both occasions, the three-way switch is the load-side three-way switch.

Task (e), determining whether voltage is being supplied to the load, is accomplished by the "voltage checker" 704 in the load-side three-way switch 740 detecting voltage on the common terminal 741; if voltage exists on the common terminal, voltage is being provided to the load. In Task (e), the "voltage checker" 704 performs the function of the load status detector.

Task (f), determining which traveler wire within each pair of traveler wires is part of the signal channel is accomplished by the actuator in the "channel selector" of each switch performing the "voltage detection" function, detecting voltage on one of the two wires in the pair of traveler wires, and using the opposite traveler wire as part of the signal channel. The composition of the "channel selector" and the manner that the "channel selector" isolates the "AC mains channel" and the "signal channel" is the same as was discussed in the DC signal voltage embodiment.

Task (g), signal generation, generating a signal when voltage is being supplied to the load, is accomplished by the microprocessor in the load-side three-way switch. If voltage was determined to exist on the common terminal of the load-side three-way switch in task (e), a signal voltage (e.g., +5 VDC) is directed to the traveler wire that was determined to be a part of the signal channel in task (f).

Task (h), signal detection, upon recognizing signal voltage on the signal channel, the "indicator controller" in the switches that are not the load-side three-way switch cause the indicator in the switch to illuminate, task (i).

As used herein, the term "dim level" refers to the power output level of the load, typically a lighting level, resulting from the load limiting function performed by the dimming circuitry in the dimmer switch. The term "dim level signal" refers to a signal that travels on the signal channel to command the dimmer to limit the load to a particular "dim level". A "dim level signal" is typically generated by a remote dimmer switch. The term "dim status signal" refers to a signal that travels on the signal channel that reports the "dim level" of the load. A "dim status signal" is typically generated by a dimmer switch and is detected by remote dimmer switches, allowing the remote dimmers to activate an indicator representative of the "dim level" at the switch.

The second and third communications take place in electrical circuits in which one of the switches is a dimmer switch. The second communication is from the dimmer switch to all of the other switches in the electrical circuit, reporting the dim level of the load, such that all switches can indicate the dim level of the load. The third communication is from any switch in the electrical circuit to the dimmer to command the dim level of the load.

In an electrical circuit containing multiple switches, typically there is only one switch containing dimming circuitry that performs the "load limiting" function. This switch is typically at one of the two three-way switches and is referred to as the "master dimmer switch" or the "dimmer switch" or simply the "dimmer". "Remote dimmers" in the electrical circuit communicate with the dimmer switch, commanding the dimmer switch to set the load to a particular dim level.

Figure 8:
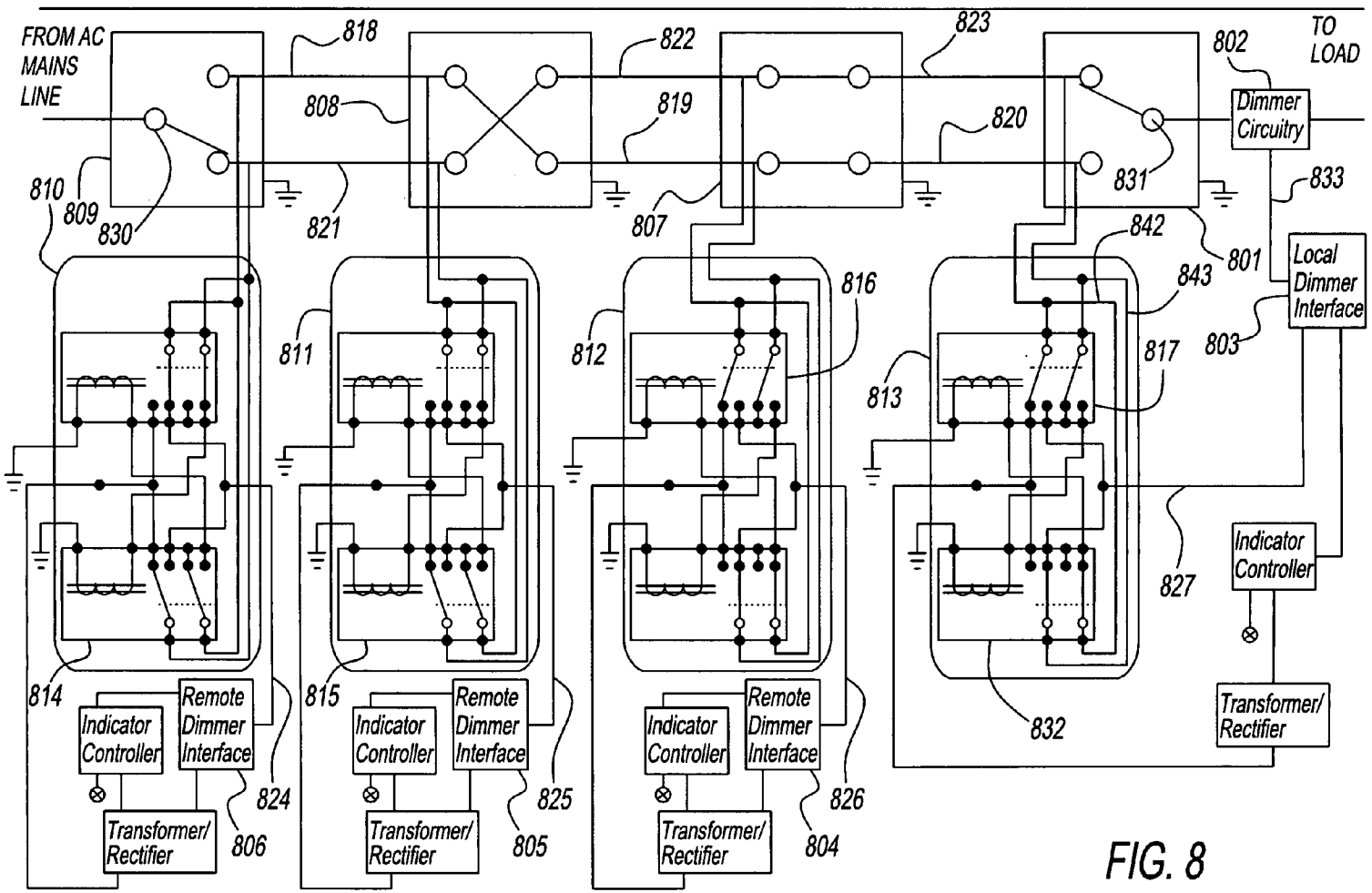
FIG. 8 shows the dimmer preferred embodiment of the present invention.

FIG. 8 shows a first three-way switch 809 having a common terminal 830 coupled to a hot conductor of the mains line, a last three-way switch 801 having a common terminal 831 coupled to the load, and two four-way switches 808, 807. Each switch in the electrical circuit is connected to a next switch by a first traveler wire 818, 822, 823 and a second traveler wire 821, 819, 820. A signal generator, in one embodiment comprising a local dimmer interface 803, generates a sequence comprising digital communication pulses (e.g. +5 VDC and −5 VDC) on the output, conductor 827, in response to a condition—the dim level reported by the dimming circuitry 802 on an input 833. A signal generator channel selector 813 comprises a voltage detector and a signal generator channel selector switch. In this embodiment the voltage detector comprises actuators of mechanical relays 817, 832; an input, conductor 842, coupled to the first traveler wire 823 and an input, conductor 843, coupled to the second traveler wire 820; and an output, an electromagnetic field generated by the actuator of first relay 817 and capable of engaging the movable contacts in first relay 817 when AC mains voltage is present on the first traveler wire 823, or generated by actuator of second relay 832 and capable of engaging the movable contacts in second relay 832 when AC mains voltage is present on the second traveler wire 820. In this embodiment, the signal generator channel selector switch comprises the movable contacts in first relay 817, actuated by a control input, the actuator in first relay 817 when AC mains voltage is present on first traveler wire 823, and the movable contacts in second relay 832, actuated by a control input, the actuator in second relay 832 when AC mains voltage is present on second traveler wire 820; a signal input, conductor 827, coupled to the signal generator, local dimmer interface 803; a first signal output, conductor 842, coupled to the first traveler wire 823 and a second signal output, conductor 843, coupled to the second traveler wire 820. In the invention assemblies that are not in the load-side three-way switch, FIG. 8 shows signal detecting channel selectors 810, 811, 812. Each signal detecting channel selector comprises a voltage detector and a signal detecting channel selector switch. Functioning substantially similar to the voltage detector in the signal generator channel selector 813 and the signal generator channel selector switch described above, in each of the invention assemblies that is not in the load-side three-way switch, the voltage detector in the signal detecting channel selectors detect which of the first traveler wire or the second traveler wire is connected to the AC mains line, and the signal detecting channel selector switches cause the first traveler wire or the second traveler wire that is not connected to the AC mains line to connect to the signal. The signal is coupled to a signal detector, in this embodiment, comprising remote dimmer interfaces 804, 805, 806, coupled to indicator controllers and one or more indicator lights in each invention assembly. In another embodiment, the signal generators comprise the remote dimmer interfaces 804, 805, 806, generating a signal comprising a sequence of digital communication pulses (e.g. +5 VDC and −5 VDC) on the outputs, conductors 824, 825, 826, in response to a desired dim level requested on the input, buttons on remote dimmer interfaces 804, 805, 806. In this embodiment, the signal travels on the signal channel to the signal detector comprising the local dimmer interface which communicates the desired dim level to dimmer circuitry 802.

Whereas typically remote dimmers do not use conventional wiring for three-way and four-way switches, with the system, device and method of the present invention, remote dimmers properly function in electrical circuits wired using conventional wiring for three-way and four-way switches, and any number of standard three-way and four-way switches can coexist with any number of remote dimmers in the electrical circuit. This is a significant advantage over the prior art.

Referring to FIG. 8, the load-side three-way switch is the dimmer switch 801 with the dimming circuitry 802 incorporated into the switch and the local dimmer interface 803 attached to the exterior of the switch housing. The dimmer switch 801 is controlled locally with the local dimmer interface 803 which is attached to the dimming circuitry 802. The dimmer switch 801 is controlled remotely by the remote dimmer interfaces 804 805 806 at the other three-way 809 and four-way switches 807 808 in the electrical circuit. The remote dimmer interfaces 804 805 806 are connected to the signal input/outputs 824 825 826 of the channel selectors 814 815 816. The signal input/output connections 824 825 826 827 are used as signal inputs for signal generation and as signal outputs for signal detection. The dimming circuitry 802 contains different resistances that control the switching of a triac thereby controlling the output to the load e.g. the brightness of a light. The local dimmer interface 803 directs the dimming circuitry 802 to select a resistance corresponding to a desired dim level, either continuously using a potentiometer or discretely using push buttons and separate resistors. The remote dimmer interfaces 804 805 806 communicate with the local dimmer interface 803, allowing the remote switches 807 808 809 to command the dim level. In the dimmer preferred embodiment the dimmer interfaces contain a series of five buttons representing dim levels of 20% of the maximum output, 40% of the maximum output, 60% of the maximum output, 80% of the maximum output, and the maximum output. The indicators on each switch are five LED lights representing the same output percentages. In the dimmer preferred embodiment, the on/off function of the load is performed with the three-way or four-way switches in the electrical circuit rather than the dimmer circuitry limiting the load to zero percent. When the load is not receiving any voltage, none of the indicator LED lights are illuminated. In the present invention, the dimmer circuitry can be in either of the two three-way switches in the electrical circuit.

The term "digital communications" refers to sending and receiving a sequence of voltages (e.g., −5 VDC and +5 VDC) representing bits (0's and 1's). The terms "serial communications" and "asynchronous communications" refer to sending and receiving bits, one bit at a time.

For the second communication, the local dimmer interface 803 functions as the "signal generator" and is attached to the signal input 827 of the channel selector 813. The remote dimmer interfaces 804 805 806 function as the "signal detectors" and are attached to the signal outputs 824 825 826 of the channel selectors 810 811 812. The signal channel 818 819 820 is isolated by the line voltage carried by travelers 821 822 823, actuating the appropriate relays 814 815 816 817 in the "signal generator channel selector" 813 and the "signal detecting channel selectors" 810 811 812. A dim status signal is generated when the dimming circuitry receives voltage i.e. when any switch causes voltage to be supplied to the load. The signal generator uses serial communications to send a sequence of digital communication pulses representing the current dim level of the load e.g. "0001" could represent 20% of the maximum output, "0010" could represent 40% of the maximum output, "0011" could represent 60% of the maximum output, etc. The signal detectors in the remote dimmer interfaces 804 805 806 receive the dim status signal, interpret the signal and the indicator controllers activate the indicator, in this embodiment illuminating one of five LEDs. In other embodiments, the indicator could be an indicator light glowing with varying levels of brightness, corresponding to the output level of the load; an LCD screen wherein the dim level is displayed numerically as a percentage of the maximum; or one or more lights or LEDs using different colors to represent a differing levels of output of the load.

For the third communication, the remote dimmer interfaces 804 805 806 function as the "signal generators" and are attached to the signal inputs 824 825 826 of the channel selectors 810 811 812. The local dimmer interface 803 functions as the "signal detector" and is attached to the signal output 827 of channel selector 813. The "signal generator channel selector" comprises channel selector 813 and the "signal detecting channel selectors" comprise channel selectors 810 811 812. The signal channel 818 819 820 is isolated by the line voltage carried by travelers 821 822 823, actuating the appropriate relays 814 815 816 817 in the channel selectors 810 811 812 813. A dim level signal is generated when one of the buttons on one of the remote switches is pressed. The signal generator uses serial communications to send a sequence of digital communication pulses representing the the desired dim level of the load e.g. "1001" could represent 20% of the maximum output, "1010" could represent 40% of the maximum output, "1011" could represent 60% of the maximum output, etc. The signal detector in the local dimmer interface 803 receives the dim level signal, interprets the signal and commands the dimming circuitry to set the load to the desired dim level. After changing a dim level, the local dimmer interface sends a dim status signal to update the indicators in all of the remote switches.

The fourth and fifth communications take place in electrical circuits in which one of the switches is a timer switch, typically a three-way timer switch. The fourth communication is from the timer switch, to all of the other switches in the electrical circuit, reporting that the load, typically a set of lights, will shut off in a number of seconds so that all switches can warn of the shutoff using an audible indicator or other means. The fifth communication originates in any remote switch in the electrical circuit and is detected in the timer switch to command a "timer reset" such that the shutoff is cancelled or delayed.

Figure 9:
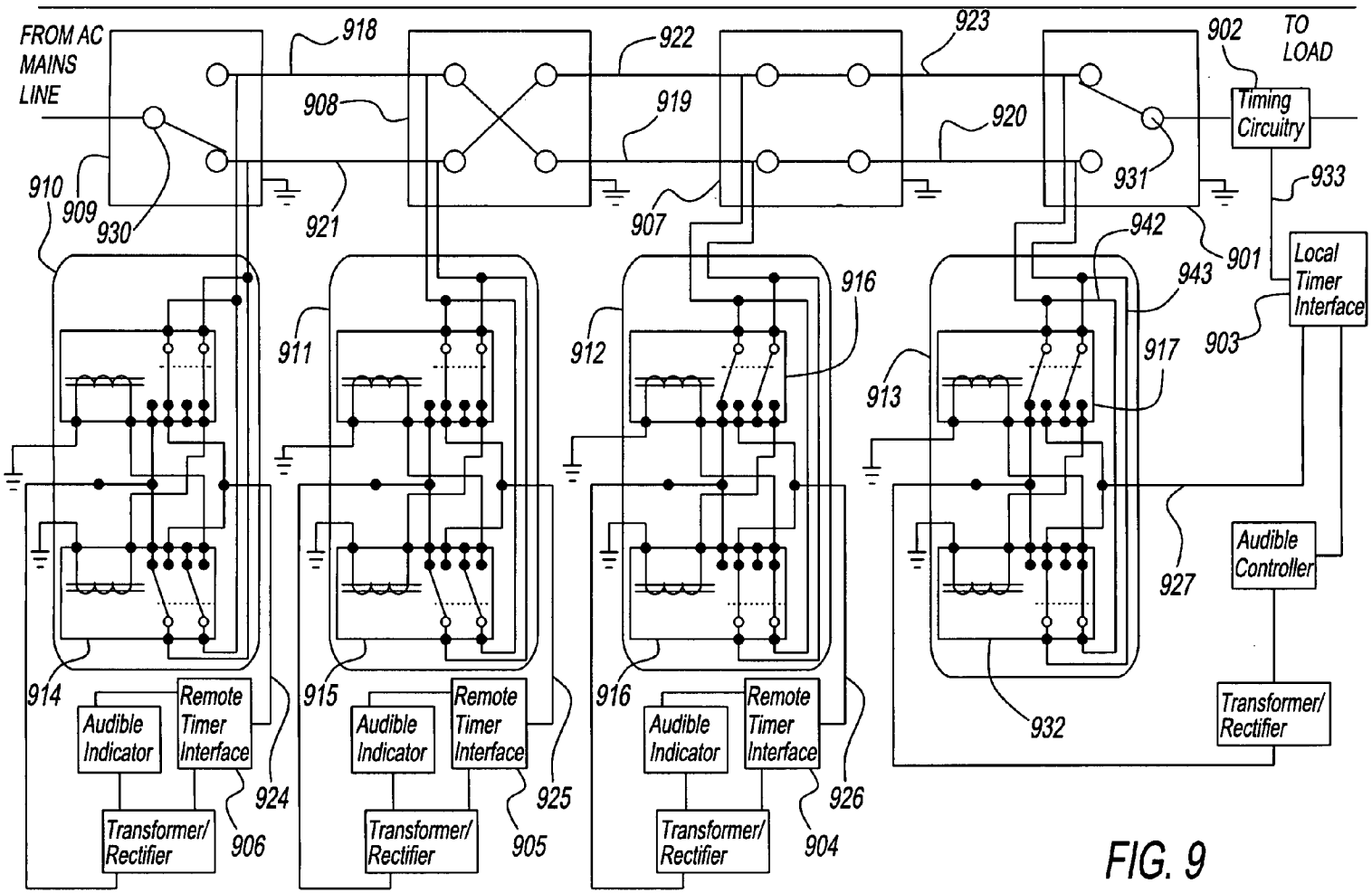
FIG. 9 shows the timer preferred embodiment of the present invention.

FIG. 9 shows a first three-way switch 909 having a common terminal 930 coupled to a hot conductor of the mains line, a last three-way switch 901 having a common terminal 931 coupled to the load, and two four-way switches 908, 907. Each switch in the electrical circuit is connected to a next switch by a first traveler wire 918, 922, 923 and a second traveler wire 921, 919, 920. A signal generator, in one embodiment comprising a local timer interface 903, generates a sequence comprising digital communication pulses (e.g. +5 VDC and −5 VDC) on the output, conductor 927, in response to a condition—the number of minutes to the shutoff time reported by the timing circuitry 902 on an input 933. A signal generator channel selector 913 comprises a voltage detector and a signal generator channel selector switch. In this embodiment the voltage detector comprises actuators of mechanical relays 917, 932; an input, conductor 942, coupled to the first traveler wire 923 and an input, conductor 943, coupled to the second traveler wire 920; and an output, an electromagnetic field generated by the actuator of first relay 917 and capable of engaging the movable contacts in first relay 917 when AC mains voltage is present on the first traveler wire 923, or generated by actuator of second relay 932 and capable of engaging the movable contacts in second relay 932 when AC mains voltage is present on the second traveler wire 920. In this embodiment, the signal generator channel selector switch comprises the movable contacts in first relay 917, actuated by a control input, the actuator in first relay 917 when AC mains voltage is present on first traveler wire 923, and the movable contacts in second relay 932, actuated by a control input, the actuator in second relay 932 when AC mains voltage is present on second traveler wire 920; a signal input, conductor 927, coupled to the signal generator, local timer interface 803; a first signal output, conductor 942, coupled to the first traveler wire 923 and a second signal output, conductor 943, coupled to the second traveler wire 920. In the invention assemblies that are not in the load-side three-way switch, FIG. 9 shows signal detecting channel selectors 910, 911, 912. Each signal detecting channel selector comprises a voltage detector and a signal detecting channel selector switch. Functioning substantially similar to the voltage detector in the signal generator channel selector 913 and the signal generator channel selector switch described above, in each of the invention assemblies that is not in the load-side three-way switch, the voltage detector in the signal detecting channel selectors detect which of the first traveler wire or the second traveler wire is connected to the AC mains line, and the signal detecting channel selector switches cause the first traveler wire or the second traveler wire that is not connected to the AC mains line to connect to the signal. The signal is coupled to a signal detector, in this embodiment, comprising remote timer interfaces 904, 905, 906, coupled to audible indicators in each invention assembly. In another embodiment, the signal generators comprise the remote timer interfaces 904, 905, 906, generating a signal comprising a sequence of digital communication pulses (e.g. +5 VDC and −5 VDC) on the outputs, conductors 924, 925, 926, in response to a reset signal requested on the input, buttons on remote timer interfaces 904, 905, 906. In this embodiment, the signal travels on the signal channel to the signal detector comprising the local timer interface which communicates a preset number of minutes to add to the shutoff time to timing circuitry 902.

Referring to FIG. 9, the load-side three-way switch 901 is the timer switch with timing circuitry 902 incorporated into the switch. The shutoff time, based on the day of the week; the number of seconds prior to shutoff to send the shutoff warning signal; and the number of minutes a "timer reset" is to add to the shutoff time, based on the day of the week and the time of the day, are set from the local timer interface 903 connected to the timing circuitry 902. The timer switch 901 is accessed remotely by the remote timer interfaces 904 905 906 at the other three-way 909 and four-way switches 907 908 in the electrical circuit. The remote timer interfaces 904 905 906 have reset buttons that add a preset amount of time to the shutoff time. The remote timer interfaces 904 905 906 are connected to the signal input/outputs 924 925 926 of the channel selectors 910 911 912. The signal input/output connections 924 925 926 927 are used as signal inputs for signal generation and as signal outputs for signal detection. The timing circuitry 902 shuts off the load at a specified time. The remote timer interfaces 904 905 906 communicate with the local timer interface 903 allowing the remote switches 907 908 909 to add time to the shutoff time. In the present invention, the timer circuitry can be in either of the two three-way switches in the electrical circuit.

For the fourth communication, the local timer interface 903 functions as the "signal generator" and is attached to the signal input 927 of the channel selector 913. The remote timer interfaces 904 905 906 function as the "signal detectors" and are attached to the signal outputs 924 925 926 of the channel selectors 910 911 912. The signal channel 918 919 920 is isolated by the line voltage carried by travelers 921 922 923, actuating the appropriate relays 914 915 916 917 in the "signal generator channel selector" 913 and the "signal detecting channel selectors" 910 911 912. A shutoff warning signal is generated a specified number of seconds before the shutoff time. The signal generator uses serial communications to send the shutoff warning signal. The signal detectors in the remote timer interfaces 904 905 906 receive the shutoff warning signal, interpret the signal and, in the timer preferred embodiment, activate the audible indicator. In another embodiment, a signal from the local timer interface could generate a numeric value representing the amount of time remaining before the load will shut off, and display the value on an LCD indicator screen connected to the remote timer interface.

For the fifth communication, the remote timer interfaces 904 905 906 function as the "signal generators" and are attached to the signal inputs 924 925 926 of the channel selectors 910 911 912. The local timer interface 903 functions as the "signal detector" and is attached to the signal output 927 of channel selector 913. The "signal generator channel selector" comprises channel selector 913 and the "signal detecting channel selectors" comprise the channel selectors 910 911 912. The signal channel 918 919 920 is isolated by the line voltage carried by travelers 921 922 923, actuating the appropriate relays 914 915 916 917 in the channel selectors 910 911 912 913. A reset signal is generated when a reset button on a remote timer interface 904 905 906 in one of the remote switches 907 908 909 is pressed. The signal generator uses serial communications to send a sequence of digital communication pulses representing a reset signal. The signal detector in the local timer interface 903 receives the reset signal, interprets the signal and commands the timing circuitry to add the preset number of minutes to the shutoff time. In another embodiment, the shutoff time could be set, and the timer function initiated from the remote timer interfaces.

Although described with mechanical relays, the channel selectors of the dimmer embodiments and the timer embodiments of the present invention could use solid-state relays (SSRs) to isolate the signal channels.

Although this invention has been described in certain specific embodiments, many additional modifications and variations would be apparent to those skilled in the art. It is therefore to be understood that this invention may be practiced otherwise than as specifically described. Thus, the embodiments of the invention described herein should be considered in all respects as illustrative and not restrictive, the scope of the invention to be determined by the appended claims and their equivalents rather than the foregoing description.

What is claimed is:

1. A channel selection system for an electrical circuit controlling voltage applied from a mains line to a load, the electrical circuit comprising a plurality of switches comprising at least a first three-way switch having a common terminal coupled to a hot conductor of the mains line and a last three-way switch having a common terminal coupled to the load, in which each switch in the electrical circuit is connected to a next switch in the electrical circuit by a first traveler wire and a second traveler wire, the system comprising:

a) a signal generator having an input and an output, such that the signal generator generates a signal on the output in response to a condition on the input;

b) a signal generator channel selector comprising:

i) a voltage detector having inputs coupled to the first traveler wire and to the second traveler wire and an output;

ii) a signal generator channel selector switch having a control input coupled to the output of the voltage detector, a signal input coupled to the output of the signal generator, a first signal output coupled to the first traveler wire and a second signal output coupled to the second traveler wire, such that the voltage detector detects which of the first traveler wire and the second traveler wire is connected to the hot conductor of the mains line, and the voltage detector controls the output of the voltage detector coupled to the control input of the signal generator channel selector switch to cause the signal generator channel selector switch to connect the signal input of the signal generator channel selector switch to the first signal output or the second signal output, thereby coupling the signal from the signal generator to whichever of the first traveler wire or the second traveler wire is not connected to the hot conductor of the mains line;

c) a signal detecting channel selector, comprising:

i) a voltage detector having inputs coupled to the first traveler wire and to the second traveler wire and an output;

ii) a signal detecting channel selector switch having a control input coupled to the output of the voltage detector, a signal output, a first signal input coupled to the first traveler wire and a second signal input coupled to the second traveler wire, such that the voltage detector detects which of the first traveler wire and the second traveler wire is connected to the hot conductor of the mains line, and the voltage detector controls the output of the voltage detector coupled to the control input of the signal detecting channel selector switch to cause the signal detecting channel selector switch to connect the signal output of the signal detecting channel selector switch to the first signal input or the second signal input, thereby coupling whichever of the first traveler wire or the second traveler wire is not connected to the hot conductor of the mains line to the signal output of the signal detecting channel selector switch; and d) a signal detector having an input coupled to the signal output of the signal detecting channel selector switch and an output responsive to a signal detected at the input.

2. The channel selection system of claim 1, further comprising a load status detector coupled to the common terminal of the last three-way switch having an output coupled to the input of the signal generator, such that the signal generator generates a signal on the output of the signal generator when the load status detector detects that a voltage from the hot conductor of the mains line is present on the common terminal of the last three-way switch.

3. The channel selection system of claim 1, in which the signal generator and the signal generator channel selector are integrated into at least one of the plurality of switches of the circuit.

4. The channel selection system of claim 3, in which the at least one of the plurality of switches is the last three-way switch.

5. The channel selection system of claim 1, in which the signal detecting channel selector and the signal detector are integrated into at least one of the plurality of switches of the circuit.

6. The channel selection system of claim 1, in which the circuit comprises at least one four-way switch between the first three-way switch and the last three-way switch.

7. The channel selection system of claim 1, in which the output of the signal detector is coupled to an indicator, such that the indicator is activated when a signal from the signal generator is present.

8. The channel selection system of claim 7, in which the indicator is a light.

9. The channel selection system of claim 7, in which the indicator is an audible tone generator.

10. The channel selection system of claim 1, in which the signal is an AC voltage.

11. The channel selection system of claim 1, in which the signal is a DC voltage.

12. The channel selection system of claim 1, in which the signal is a modulated tone of a selected frequency.

13. The channel selection system of claim 1, in which the signal is a digital communications signal.

14. The channel selection system of claim 1, in which a return path is ground.

15. The channel selection system of claim 1, in which a return path is a neutral path coupling a neutral conductor of the mains line to the load.

16. The channel selection system of claim 1, in which:

a) at least one of the plurality of switches includes a dimmer, and the signal generator is at the switch which includes the dimmer, b) the signal generator generates a dim status signal responsive to a dim level at the signal generator input, c) the signal detector is at a switch other than the switch which includes the dimmer, and d) the output of the signal detector is coupled to an indicator that indicates a dim level of the load, such that when the signal generator generates the dim status signal on its output, the dim status signal is switched to the traveler wire selected by the signal generator channel selector switch, the signal detector receives the signal from the traveler wire selected by the signal detector channel selector switch, and the indicator coupled to the output of the signal detector indicates the dim level of the load.

17. The channel selection system of claim 1, in which:

a) one of the plurality of switches includes a dimmer, and b) at least one of the plurality of switches other than the switch including the dimmer has a user input, the signal generator being at the switch which includes the user input, c) the signal generator generates a dim level signal responsive to the user input, and d) the signal detector is at the switch which includes the dimmer, and the output of the signal detector is coupled to the dimmer, such that when the signal generator generates a dim level signal on its output, the dim level signal is switched to the traveler wire selected by the signal generator channel selector switch, the signal detector receives the signal from the traveler wire selected by the signal detector channel selector switch, and the dimmer is actuated by the output of the signal detector in accordance with the dim level signal.

18. The channel selection system of claim 1, in which at least one of the plurality of switches further comprises a timer for actuating the switch at a selected time.

19. The channel selection system of claim 18, in which the timer sends a signal on the traveler wire selected by the signal generating channel selector switch to activate the signal detectors at the other switches prior to actuating the switch.

20. The channel selection system of claim 18, in which the timer further comprises a reset input coupled to the signal detecting channel selector switch of the switch having the timer, and in which each of the other switches comprises a signal generator coupled to the signal generating channel selector switch, such that any of the switches may send a signal on the traveler wire selected by the signal generating channel selector switch to reset the timer through the reset input.

21. A channel selection device for use with a switch in an electrical circuit controlling voltage applied from a mains line to a load, the electrical circuit comprising a plurality of switches comprising at least a first three-way switch having a common terminal coupled to a hot conductor of the mains line and a last three-way switch having a common terminal coupled to the load, in which each switch in the electrical circuit is connected to a next switch in the electrical circuit by a first traveler wire and a second traveler wire; the device comprising:

a) a voltage detector coupled to the first traveler wire and the second traveler wire on one of the plurality of switches and having an output, and b) a channel selector comprising a control input coupled to the output of the voltage detector, a first port coupled to the first traveler wire, a second port coupled to the second traveler wire, and a third port switchable by the control input to either the first port or the second port;

such that the voltage detector detects which of the first traveler wire and the second traveler wire is not connected to the hot conductor of the mains line, and the output of the voltage detector causes the third port of the channel selector to be switched to whichever of the first port of the channel selector or the second port of the channel selector is coupled to the not connected one of the first traveler wire or the second traveler wire.

22. The channel selection device for use with a switch of claim 21, further comprising:

a signal generator having an input and an output bearing a signal in response to a condition on the input, the output being coupled to the third port of the channel selector, such that the signal at the output of the signal generator is coupled to whichever of the first traveler wire or the second traveler is not connected to the hot conductor of the mains line.

23. The channel selection device for use with a switch of claim 22, in which the device is integrated into at least one of the plurality of switches of the circuit.

24. The channel selection device for use with a switch of claim 22, in which the signal is an AC voltage.

25. The channel selection device for use with a switch of claim 22, in which the signal is a DC voltage.

26. The channel selection device for use with a switch of claim 22, in which the signal is a modulated tone of a selected frequency.

27. The channel selection device for use with a switch of claim 22, in which the signal is a digital communications signal.

28. The channel selection device for use with a switch of claim 22, in which the signal is a load status signal, in which the signal generator is at the last three-way switch, further comprising a load status detector coupled to the common terminal of the last three-way switch having an output coupled to the input of the signal generator, such that the signal generator generates the load status signal on the output of the signal generator when the load status detector detects that a voltage from the hot conductor of the mains line is present on the common terminal of the last three-way switch.

29. The channel selection device for use with a switch of claim 22, in which at least one of the plurality of switches includes a dimmer, in which the signal is a dim status signal, in which the signal generator is at the switch which includes the dimmer, such that when the signal generator generates the dim status signal on its output, the signal is switched to the traveler wire selected by the channel selector.

30. The channel selection device for use with a switch of claim 22, in which at least one of the plurality of switches includes a dimmer, in which the signal is a dim level signal, in which the signal generator is at a switch other than the switch which includes the dimmer, such that when the signal generator generates the dim level signal on its output, the signal is switched to the traveler wire selected by the channel selector.

31. The channel selection device for use with a switch of claim 21, in which the channel selector further comprises:

a) a first relay having an actuator and double-pole double-throw contacts;

b) a second relay having an actuator and double-pole double-throw contacts;

in which the actuator of the first relay is coupled to the first traveler wire through a normally closed contact of the second relay, and the actuator of the second relay is coupled to the second traveler wire through a normally closed contact of the first relay; and the third port is coupled to the second traveler wire through a normally closed contact of the second relay, and also coupled to the first traveler wire through a normally closed contact of the first relay;

such that when voltage from the hot conductor of the mains line is present on the first traveler wire, the actuator of the first relay is actuated and the third port is coupled to the second traveler wire, and when voltage from the hot conductor of the mains line is present on the second traveler wire the actuator of the second relay is actuated, and the third port is coupled to the first traveler wire.

32. The channel selection device for use with a switch of claim 21, further comprising:

a signal detector having an input coupled to the third port of the channel selector, and an output responsive to a signal detected at the input, such that the signal detector detects the signal on whichever of the first traveler wire or the second traveler is not connected to the hot conductor of the mains line.

33. The channel selection device for use with a switch of claim 32, in which the output of the signal detector is coupled to an indicator.

34. The channel selection device for use with a switch of claim 33, in which the indicator is a light.

35. The channel selection device for use with a switch of claim 33, in which the indicator is an audible tone generator.

36. The channel selection device for use with a switch of claim 32, in which the device is integrated into at least one of the plurality of switches of the circuit.

37. The channel selection device for use with a switch of claim 32, in which the signal is a load status signal, in which the signal detector is at a switch other than the last three-way switch, further comprising an indicator coupled to the output of the signal detector, such that the signal detector receives the signal from the traveler wire selected by the channel selector, and the indicator is activated when the signal is present.

38. The channel selection device for use with a switch of claim 32, in which at least one of the plurality of switches includes a dimmer, in which the signal is a dim status signal, in which the signal detector is at a switch other than the switch which includes the dimmer, further comprising an indicator coupled to the output of the signal detector, such that the signal detector receives the signal from the traveler wire selected by the channel selector, and the indicator indicates the dim level of the load.

39. The channel selection device for use with a switch of claim 32, in which at least one of the plurality of switches includes a dimmer, in which the signal is a dim level signal, in which the signal detector is at the switch which includes the dimmer, such that the signal detector receives the signal from the traveler wire selected by the channel selector; and the dimmer is actuated by the output of the signal detector in accordance with the dim level signal.

40. The channel selection device for use with a switch of claim 21, in which a) the channel selector further comprises:

i) a line switcher coupled to each contact on the switch, having an output;

ii) a voltage detector having an input coupled to the output of the line switcher and an output;

iii) a microprocessor having inputs coupled to the output of the voltage detector and to the output of the line switcher and an output;

iv) a channel director having inputs coupled to the first traveler wire and the second traveler wire, and an output; and b) a signal detector comprises an indicator controller having inputs coupled to the output of the microprocessor and to the output of the channel director, and an output;

the microprocessor being programmed such that the device identifies a hot terminal on the switch to be used to power the invention's indicator and circuitry, determines whether the switch is a three-way switch or a four-way switch, and if the switch is a three-way switch, identifies whether it is the first three-way switch or the last three-way switch; and recognizes the presence of the signal being sent by a signal generator.

41. The channel selection device for use with a switch of claim 21, in which the switch is a three-way switch.

42. The channel selection device for use with a switch of claim 21, in which the switch is a four-way switch.

43. The channel selection device for use with a switch of claim 21, in which the device is integrated into at least one of the plurality of switches of the circuit.

44. A method of signaling in an electrical circuit controlling voltage applied from a mains line to a remote load, the electrical circuit comprising a plurality of switches comprising at least a first three-way switch having a common terminal coupled to a hot conductor of the mains line and a last three-way switch having a common terminal coupled to the load, in which each switch in the electrical circuit is connected to a next switch in the electrical circuit by a first traveler wire and a second traveler wire, the method comprising:

a) in at least one of the plurality of switches:

i) detecting which of the first traveler wire and the second traveler wire is connected to the hot conductor of the mains line, ii) applying a signal to whichever of the first traveler wire or the second traveler wire is not connected to the hot conductor of the mains line;

b) in at least one of the plurality of switches, detecting the signal on whichever of the first traveler wire and the second traveler wire is not connected to the hot conductor of the mains line.

45. The method of claim 44, in which the step of detecting a signal comprises:

a) detecting which of the first traveler wire and the second traveler wire is not connected to the hot conductor of the mains line;

b) switching a signal detector to the not connected first traveler wire or the second traveler wire.

46. The method of claim 45 further comprising the signal detector activating an indicator when the signal is present.

47. The method of claim 44, in which the at least one of the plurality of switches in step (a) is the last three-way switch, and the method further comprises generating the signal at the last three-way switch when a voltage from the hot conductor of the mains line is present on the common terminal of the last three-way switch.

48. The method of claim 44, in which the signal is an AC voltage.

49. The method of claim 44, in which the signal is a DC voltage.

50. The method of claim 44, in which the signal is a modulated tone of a selected frequency.

51. The method of claim 44, in which the signal is a digital communications signal.

52. The method of claim 44, in which the at least one of the plurality of switches in step (b) includes a dimmer, in which the signal is a dim level signal, and step (b) further comprises activating the dimmer responsive to the dim level signal.

53. The method of claim 52, in which the step of detecting the dim level signal comprises:

a) detecting which of the first traveler wire and the second traveler wire is not connected to the hot conductor of the mains line;

b) switching a signal detector to the not connected first traveler wire or the second traveler wire.

54. The method of claim 44, in which the at least one of the plurality of switches in step (a) includes a dimmer, in which the signal is a dim status signal representative of the dim level of the dimmer, and step (b) further comprises activating an indicator to indicate the dim level of the dimmer.

* * * * *